US008033660B2

(12) United States Patent
Nakazawa et al.

(10) Patent No.: US 8,033,660 B2
(45) Date of Patent: Oct. 11, 2011

(54) ACTIVE-ENERGY RAY CURABLE INK-JET RECORDING APPARATUS

(75) Inventors: Yusuke Nakazawa, Kanagawa (JP); Toshiyuki Makuta, Kanagawa (JP); Tsutomu Umebayashi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 626 days.

(21) Appl. No.: 12/057,167

(22) Filed: Mar. 27, 2008

(65) Prior Publication Data

US 2008/0238998 A1 Oct. 2, 2008

(30) Foreign Application Priority Data

Mar. 29, 2007 (JP) ..... P2007-089710

(51) Int. Cl.
*B41J 2/01* (2006.01)

(52) U.S. Cl. ..... 347/102; 347/42; 347/96; 347/98

(58) Field of Classification Search ..... 347/102, 347/42, 96, 98
See application file for complete search history.

(56) References Cited

U.S. PATENT DOCUMENTS

| | | | | |
|---|---|---|---|---|
| 6,236,752 | B1 * | 5/2001 | Katayama et al. | 382/183 |
| 2001/0020964 | A1 * | 9/2001 | Irihara et al. | 347/43 |
| 2002/0105572 | A1 | 8/2002 | Testardi et al. | |
| 2003/0035037 | A1 * | 2/2003 | Mills et al. | 347/102 |
| 2004/0030010 | A1 | 2/2004 | Babler | |
| 2004/0119802 | A1 * | 6/2004 | Yoneyama et al. | 347/102 |
| 2005/0219293 | A1 * | 10/2005 | Kachi | 347/14 |
| 2006/0214984 | A1 | 9/2006 | Hirakawa | |
| 2006/0238592 | A1 | 10/2006 | Kadomatsu et al. | |
| 2007/0013759 | A1 * | 1/2007 | Kadomatsu et al. | 347/102 |
| 2007/0024684 | A1 * | 2/2007 | Konno et al. | 347/95 |
| 2007/0046720 | A1 * | 3/2007 | Konno et al. | 347/21 |
| 2007/0176995 | A1 * | 8/2007 | Kadomatsu et al. | 347/103 |
| 2007/0188541 | A1 * | 8/2007 | Hoshino | 347/21 |
| 2008/0044587 | A1 * | 2/2008 | Maeno et al. | 427/487 |
| 2009/0315926 | A1 * | 12/2009 | Yamanobe | 347/6 |

FOREIGN PATENT DOCUMENTS

| | | | |
|---|---|---|---|
| EP | 0 256 456 | A2 | 2/1988 |
| EP | 0 947 331 | A1 | 10/1999 |
| EP | 0 965 458 | A1 | 12/1999 |
| EP | 1 428 669 | A2 | 6/2004 |
| EP | 1 428 869 | A3 | 6/2004 |
| EP | 1 442 892 | A1 | 8/2004 |
| EP | 1 642 739 | A2 | 4/2006 |
| EP | 1 857 510 | A1 | 11/2007 |
| JP | 2003-25707 | A | 1/2003 |

OTHER PUBLICATIONS

European Search Report issued Mar. 23, 2011 in EP 08 00 6053.
Partial European Search Report issued Dec. 7, 2010, in EP 08006053.6.

* cited by examiner

*Primary Examiner* — Matthew Luu
*Assistant Examiner* — Rut Patel
(74) *Attorney, Agent, or Firm* — Birch, Stewart, Kolasch & Birch, LLP

(57) ABSTRACT

An active-energy ray curable ink-jet recording apparatus includes: an active-energy ray irradiation source; a plurality of full-line ink-jet heads which eject a liquid functional material that is curable by an active-energy ray, onto a recording medium which is scanned and transported; and a head controller for controlling the heads to form an image on the recording medium, wherein the plurality of full-line ink-jet heads include at least a black head and a yellow head on an extreme downstream side in a direction of transporting the recording medium.

2 Claims, 4 Drawing Sheets

ACTIVE-ENERGY RAY CURABLE INK-JET RECORDING APPARATUS

FIELD OF THE INVENTION

The present invention relates to an active-energy ray curable ink-jet recording apparatus which forms an image on a recording medium with using an ink that is curable by an active-energy ray such as an electron beam or a UV ray, and more particularly to an active-energy ray curable ink-jet recording apparatus of the full-line head type.

BACKGROUND OF THE INVENTION

An ink-jet recording apparatus in which a liquid functional material that is curable by an active-energy ray such as an electron beam or a UV ray is ejected onto a recording medium with using an ink-jet head and the liquid functional material is cured by energy irradiation to form an image has features such as that it is environmentally friendly, and that it can obtain a high-resolution image which can be recorded at a high speed on various recording media, and which hardly bleeds. Particularly, development of an apparatus which uses a UV curable ink as a liquid functional material is advancing from the viewpoints of easy handling of a light source, compactness, and the like. Under these circumstances, by taking the advantage of the high-speed fixing property, a so-called single-pass ink-jet recording apparatus has been proposed in which a web-like recording medium that can be transported at a high speed is used, a head having a width that allows recording to be performed over the whole width of the recording medium is placed so as to be opposed to the recording medium in a state where the head is fixed, and recording is completed simply by causing the recording medium to pass under the head one time.

In the case where color printing is performed by such a single-pass ink-jet recording apparatus, fixations of inks are performed while stationary heads the number of which is equal to that of colors required for color reproduction are arranged in the direction of transporting a recording medium, and active-energy ray irradiating means are placed immediately downstream of the heads. In formation of an image, a complex color is reproduced by overlapping color inks with one another. Light hardly impinges on a color ink which is in a lower portion of the overlap, and therefore the curing property is sometimes insufficiently attained. By contrast, an ink-jet recording apparatus in which a first or second ink color of the lowest layer of an ink overlap on a recording medium is black (K) or cyan (C) is disclosed (for example, see JP-A-2003-25707).

SUMMARY OF THE INVENTION

However, a request for enhancing the color reproducibility of ink jet is increasing. A countermeasure to increase the amount of ink pigments remaining on a recording medium to thicken an ink is effective. In the active-energy ray curable ink-jet recording apparatus disclosed in JP-A-2003-25707, however, this countermeasure causes the problem of insufficient curing property to be significant, and therefore the curing property under high speed conditions is hardly sufficiently attained.

The invention has been conducted in view of the above-discussed circumstances. It is an object of the invention to provide an active-energy ray curable ink-jet recording apparatus which can provide a high productivity, which can perform high-quality recording on various recording media, which is compact, and which is advantageous in cost.

The object of the invention can be achieved by the following configurations.

(1) An active-energy ray curable ink-jet recording apparatus comprising: an active-energy ray irradiation source; plural full-line ink-jet heads which eject a liquid functional material that is curable by an active-energy ray, onto a recording medium which is scanned and transported; and a head controller for controlling the heads to form an image on the recording medium, wherein the plural full-line ink-jet heads include at least a black head and a yellow head on an extreme downstream side in a direction of transporting the recording medium.

According to the thus configured active-energy ray curable ink-jet recording apparatus, among the plural full-line ink-jet heads, the head for a black ink is placed at the extreme downstream position in the direction of transporting the recording medium, whereby the character quality can be improved. In the case of a yellow liquid functional material, the light absorption of a yellow pigment overlaps with the light absorption wavelength of a polymerization initiator of the liquid functional material, and hence the sensitivity is lower than other liquid functional materials. When the yellow head is placed at the extreme downstream position in the direction of transporting the recording medium in the plural full-line ink-jet heads, a yellow color is placed in the uppermost layer of a drawn image, and a sufficient active-energy ray is obtained in a short time, whereby a high-speed and sufficient curing property can be obtained. The phrase "the plural full-line ink-jet heads include at least a black head and a yellow head on an extreme downstream side in a direction of transporting the recording medium" used herein means that the yellow ink-jet head, the black ink-jet head and the final curing light source are provided in this order, or the black ink-jet head, the yellow ink-jet head and the final curing light source are provided in this order, provided that all of other ink-jet head(s) for other colors(s) are provided at a position upstream from the black and yellow ink-jet heads and the final curing light source in the direction of transporting the recording medium.

(2) In the active-energy ray curable ink-jet recording apparatus of (1) above, the head controller sets a range outside a yellow ejection range as an ejectable range of the black head.

According to the thus configured active-energy ray curable ink-jet recording apparatus, the head controller sets a range outside the yellow ejection range as an ejectable range of the black head. Therefore, black and yellow liquid functional materials both of which have a low optical transparency can be prevented from overlapping with each other, so that the curing property can be suppressed from lowering.

(3) In the active-energy ray curable ink-jet recording apparatus of (1) or (2) above, a pigment concentration of the liquid functional material is equal to or larger than 6 wt. % and smaller than 20 wt. %.

According to the thus configured active-energy ray curable ink-jet recording apparatus, the color reproducibility can be further enhanced by the pigment concentration of the liquid functional material which is set to be equal to or larger than 6 wt. % and smaller than 20 wt. %.

(4) In the active-energy ray curable ink-jet recording apparatus of any one of (1) to (3) above, the apparatus further comprises a unit for applying a clear ink for undercoating, at a position upstream from the plural full-line ink-jet heads in the direction of transporting the recording medium.

According to the thus configured active-energy ray curable ink-jet recording apparatus, an undercoating layer is given onto the recording medium by the unit for applying a clear ink for undercoating and disposed at a position upstream from the plural full-line ink-jet heads in the direction of transporting the recording medium. In the case where only the inside of the undercoating layer is adequately cured, when droplets of the liquid functional material are ejected onto the undercoating layer with partially overlapping with each other, interaction between the undercoating layer and the droplets of the liquid functional material can prevent adjacent droplets from combining into one. Therefore, any recording medium can be used, and bleeding of an image, unevenness of the width of a line such as a thin line of an image, and generation of color unevenness in a colored surface can be effectively prevented from occurring, so that a sharp line having a uniform width can be formed, and recording of an ink-jet image having a high deposited droplet density such as a reversed character can be performed with excellent reproduction of a fine image such as a thin line.

According to the invention, it is possible to provide an active-energy ray curable ink-jet recording apparatus which can provide a high productivity, which can perform high-quality recording with high color reproducibility on various recording media, which is compact, and which is advantageous in cost.

[Description of Reference Numerals and Signs]

| | |
|---|---|
| 10 | active-energy ray curable ink-jet recording apparatus |
| 52 | undercoating liquid film forming portion (unit for applying a clear ink for undercoating) |
| 64 | yellow ink-jet head (head for yellow ink) |
| 66 | black ink-jet head (head for black ink) |
| 68 | hot-cathode tube unit (active-energy ray irradiation source) |
| 70 | head unit (full-line ink-jet head) |
| 72 | final curing light source (active-energy ray irradiation source) |
| 122 | clear ink layer |
| S | recording medium |

DETAILED DESCRIPTION OF THE INVENTION

Hereinafter, the active-energy ray curable ink-jet recording apparatus of the invention will be described in detail with reference to the accompanying drawings.

Figure 1:
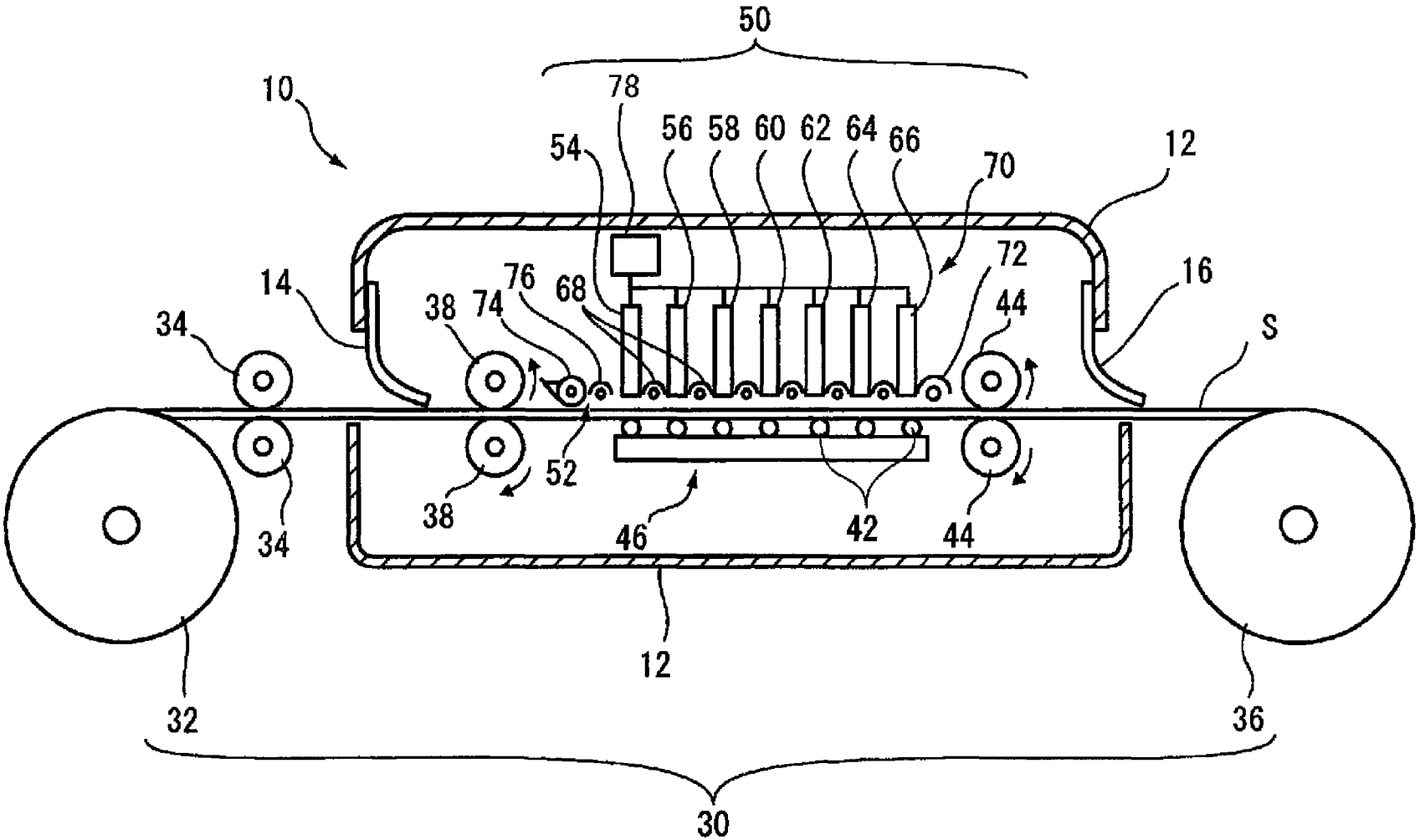
FIG. 1 is a diagram of an embodiment of the active-energy ray curable ink-jet recording apparatus of the invention.
Figure 2:
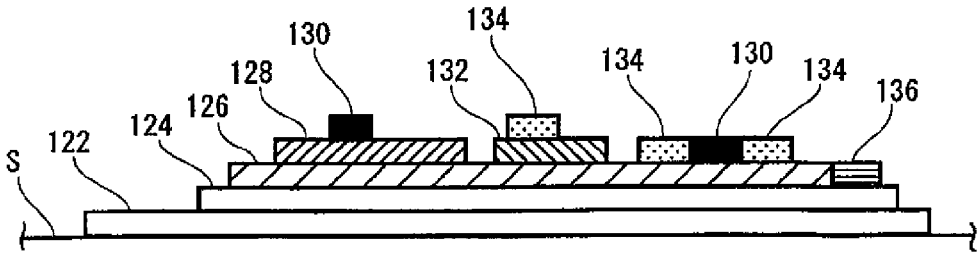
FIG. 2 is a partial sectional diagram of a recording medium on which image recording has been performed by the active-energy ray curable ink-jet recording apparatus of FIG. 1.

FIGS. 1 and 2 show an embodiment of the active-energy ray curable ink-jet recording apparatus of the invention. FIG. 1 is a diagram of an active-energy ray curable ink-jet recording apparatus of the embodiment, and FIG. 2 is a partial sectional diagram of a recording medium on which image recording has been performed by the active-energy ray curable ink-jet recording apparatus of FIG. 1.

The active-energy ray curable ink-jet recording apparatus 10 of the embodiment uses a UV curable ink which is cured by irradiation of a UV ray, as an active-energy curable liquid functional material.

As shown in FIG. 1, in a case 12 of the active-energy ray curable ink-jet recording apparatus 10, a web-like recording medium S which is wound around a feed roll 32 is extended by a transport roller 34, and passed through a flexible light-shielding door 14 to be transported into the case 12. The transported recording medium S is fed out through a flexible light-shielding door 16 which is placed on the opposite side of the case 12, and then wound around a take-up roll 36.

The recording medium S which is transported into the case 12 is held by transporting holding rollers 38, and sent onto plural supporting transporting rollers 42. The recording medium S is held by transporting holding rollers 44 which are placed on the downstream side across the supporting transporting rollers 42, undergoes scanning transportation by the supporting transporting rollers 42, and then sent out through the light-shielding door 16. On the supporting transporting rollers 42, an image recording portion 50 is placed at an opposed position across the recording medium S. In this way, a scanning transporting portion 30 is formed by the feed roll 32, the take-up roll 36, the transport roller 34, the transporting holding rollers 38, 44, and the supporting transporting rollers 42. The plural supporting transporting rollers 42 are supported by pressing means 46. The pressing means 46 is movable in a direction of approaching to or separating from a head unit 70 of the image recording portion 50 by a driving mechanism which is not shown.

In the image recording portion 50, an undercoating liquid film forming portion 52 which functions as a unit for applying a clear ink for undercoating, the head unit 70 configured by: a white ink-jet head (W) 54; a cyan ink-jet head (C) 56; a magenta ink-jet head (M) 58; an orange ink-jet head 60; a purple ink-jet head 62; a yellow ink-jet head (Y) 64; a black ink-jet head 66; and six hot-cathode tube units 68 which are disposed respectively on the downstream sides of the ink-jet heads 54, 56, 58, 60, 62, 64, and a final curing light source 72 are arranged from the upstream side in the direction of transporting the recording medium S toward the downstream side. The number of colors of the ink-jet heads is not restricted to seven which has been described above. For example, a light yellow ink-jet (LY) and a light magenta ink-jet (LM) may be added. The yellow ink-jet head (Y) 64 and the black ink-jet head 66 may be placed in a reversed manner.

The undercoating liquid film forming portion 52 comprises a reverse gravure coater 74 which is a roll coater, and an internal curing light source 76.

The image recording portion 50 applies ink-jet image recording and active-energy ray (in the embodiment, UV light) irradiation fixation, on the recording medium S which is scan transported on the supporting transporting rollers 42. An ink reservoir which stores an ink, and which supplies the ink to the image recording portion 50, or the ink-jet heads 54, 56, 58, 60, 62, 64, 66 through a supplying path (not shown) is disposed in the case 12. Among the ink-jet heads 54, 56, 58, 60, 62, 64, 66, the yellow ink-jet head (Y) 64 and the black ink-jet head 66 are placed at the extreme downstream position in the direction of transporting the recording medium S. The pigment concentration of each ink is set to be equal to or larger than 6 wt. % and smaller than 20 wt. %

In the image recording portion 50, the ink-jet heads 54, 56, 58, 60, 62, 64, 66 of the head unit 70 are disposed at image recording positions with directing their ink ejecting nozzles toward the transporting faces of the supporting transporting rollers 42. The head unit 70 is configured by full-line heads in which an array is formed in the width length of the recording medium S, and a piezo head is employed. The head unit 70 ejects inks which are curable by the active-energy ray, toward the recording medium S. The head controller 78 which is an ink-jet head driving device is connected to the head unit 70 to control the ejection amounts of the inks of respective colors.

The final curing light source 72 is a metal halide lamp, and disposed on the downstream side of the head unit 70.

The hot-cathode tube units 68 are held and placed in a number equal to the number of the inks (in the figure, six sets, and no hot-cathode tube unit is disposed for the black ink-jet head 66) in head holders which are not shown, to be combined with the head unit 70 to constitute the head unit 70. An ink supplying portion (not shown) which supplies the inks is connected to the image recording portion 50.

With reference to FIG. 2 and also to FIG. 1, the operation of drawing an image in the active-energy ray curable ink-jet recording apparatus 10 of the embodiment will be described.

A clear ink layer 122 is uniformly applied by the reverse gravure coater 74 of the undercoating liquid film forming portion 52, and the inside of the clear ink layer 122 is cured by the internal curing light source 76. The head controller 78 causes droplets of the inks to fall onto the recording medium S on the basis of input image data, thereby printing a color image. At this time, the head controller 78 sets a range outside a yellow ejection range due to the yellow ink-jet head (Y) 64 as an ejection range due to the black ink-jet head (K) 66. Alternatively, the head controller 78 may set the ejection range by extracting a black portion of image information, and removing a part of a yellow portion of the image information, the part overlapping with the black portion. According to the configuration, interaction between the clear ink layer 122 and droplets of the inks which are sequentially ejected can prevent adjacent droplets from combining into one. Therefore, any recording medium can be used, and bleeding of an image, unevenness of the width of a line such as a thin line of an image, and generation of color unevenness in a colored surface can be effectively prevented from occurring even when a pigment of high concentration which is equal to or larger than 6 wt. %, so that a sharp line having a uniform width can be formed, and recording of an ink-jet image having a high deposited droplet density such as a reversed character can be performed with excellent reproduction of a fine image such as a thin line.

The droplets of inks falling onto the recording medium S draw an image while the clear ink layer 122 is set as the lowest layer on the recording medium S. In the case of the sectional view shown in FIG. 2, for example, an image is drawn with forming layers in the sequence of a white ink layer 124, a cyan ink layer 126, an orange ink layer 128, and a black ink layer 130 on the lowest layer, an image is drawn with forming layers in the sequence of the white ink layer 124, the cyan ink layer 126, a magenta ink layer 132, and an yellow ink layer 134, an image is drawn with forming layers in the sequence of the white ink layer 124, the cyan ink layer 126, and a continuous formation of the yellow ink layer 134 and the black ink layer 130, and an image is drawn with forming layers in the sequence of the white ink layer 124 and a purple ink layer 136.

At this time, an image is drawn while the yellow ink layer 134 which is lower in sensitivity than the other ink layers 124, 126, 128, 132, 136, and the black ink layer 130 which is lower in light transmittance are overlaid on the other ink layers because, among the ink-jet heads 54, 56, 58, 60, 62, 64, 66, the yellow ink-jet head (Y) 64 and the black ink-jet head 66 are placed at the extreme downstream position in the direction of transporting the recording medium S. The ejectable range of the black ink-jet head (K) 66 is set outside the ejection range of the yellow ink-jet head (Y) 64. Therefore, the two inks do not overlap with each other, and transmitted light is not reduced more than necessary. Moreover, the black ink-jet head (K) 66 and the yellow ink-jet head (Y) 64 are placed side-by-side.

Therefore, an image can be drawn while positional displacement of the yellow ink layer 134 and the black ink layer 130 is suppressed substantially completely.

The black ink-jet head (K) 66 and the yellow ink-jet head (Y) 64 may be placed while whichever one of them is disposed on the downstream side.

EXAMPLE

Next, an example which was conducted in order to check functions and effects of the active-energy ray curable ink-jet recording apparatus 10 of the invention will be described.

(Measurement of Intensity of Light Incident on Ink Layer)

The intensity of light incident on each ink layer was measured while assuming that ink-jet heads of four colors are arranged in the sequence of the white ink-jet head (W) 54, the cyan ink-jet head (C) 56, the magenta ink-jet head (M) 58, and the yellow ink-jet head (Y) 64 in the downward direction of transportation of the recording medium S, the optical transparency of the yellow ink layer 134 is 20%, the optical transparencies of the magenta ink layer 132 and the cyan ink layer 126 are 60%, and the amount of incident light (final curing light source: metal halide lamp) is 3,000 mW/cm$^2$×0.3 sec. A configuration where ink-jet heads of four colors are arranged in the sequence of a white ink-jet head (W), a cyan ink-jet head (C), a yellow ink-jet head (Y), and a magenta ink-jet head (M) in the downward direction of transportation of the recording medium S was prepared as comparative example 1, and another configuration where ink-jet heads of four colors are arranged in the sequence of a white ink-jet head (W), a yellow ink-jet head (Y), a cyan ink-jet head (C), and a magenta ink-jet head (M) in the downward direction of transportation of the recording medium S was prepared as comparative example 2.

TABLE 1

| | Head | Intensity of light incident on ink layer (mW/cm$^2$) | | | |
|---|---|---|---|---|---|
| | arrangement | Y | M | C | W |
| Example | W, C, M, Y | 3,000 | 600 | 360 | 216 |
| Comparative example 1 | W, C, Y, M | 1,800 | 3,000 | 360 | 216 |
| Comparative example 2 | W, Y, C, M | 1,080 | 3,000 | 1,800 | 216 |

As apparent from Table 1, it is seen that, as compared with Comparative examples 1 and 2, the intensities of light incident on all the ink layers are sufficient, and a high-speed and sufficient curing property can be obtained in the invention where the four-color ink-jet heads are arranged in the sequence of the white ink-jet head (W) 54, the cyan ink-jet head (C) 56, the magenta ink-jet head (M) 58, and the yellow ink-jet head (Y) 64 in the downward direction of transportation of the recording medium S, and the yellow ink-jet head (Y) 64 is placed at the extreme downstream position in the direction of transporting the recording medium S, with respect to the other ink-jet heads 54, 56, 58.

As described above, according to the active-energy ray curable ink-jet recording apparatus 10, the black ink-jet head 66 which is used for drawing characters is placed at the extreme downstream position in the direction of transporting the recording medium S in the head unit 70 configured by the plural full-line heads, whereby the character quality can be improved. Furthermore, the yellow ink-jet head 64 for the yellow color in which the light absorption of the pigment overlaps with the light absorption wavelength of a polymerization initiator of the ink, and which is therefore lower in sensitivity than the other inks is placed at the extreme downstream position in the direction of transporting the recording medium S in the head unit 70, whereby the yellow color is placed in the uppermost layer of a drawn image, and a sufficient curing property can be obtained.

According to the active-energy ray curable ink-jet recording apparatus 10, the head controller 78 sets the ejection position of the yellow ink-jet head 64 so as not to overlap with the ejection position of the black ink-jet head 66, whereby an image can be drawn while the yellow ink is ejected before the black is ejected.

According to the active-energy ray curable ink-jet recording apparatus 10, the pigment concentration of the ink which is set to be equal to or larger than 6 wt. % and smaller than 20 wt. % enables a sufficient curing property to be obtained.

In the active-energy ray curable ink-jet recording apparatus 10, the clear ink layer 122 is given onto the recording medium S by the undercoating liquid film forming portion 52 which is disposed at the position upstream from the head unit 70. Even when ink droplets are given while producing mutually overlapping portions onto the clear ink layer 122 in which only the inside is cured, therefore, interaction between the clear ink layer 122 and the ink droplets can suppress adjacent ink droplets from combining into one. Therefore, bleeding of an image, unevenness of the width of a line such as a thin line of an image, and generation of color unevenness in a colored surface can be effectively prevented from occurring, so that a sharp line having a uniform width can be formed, and recording of an ink-jet image having a high deposited droplet density such as a reversed character can be performed with excellent reproduction of a fine image such as a thin line.

The active-energy ray curable ink-jet recording apparatus of the invention is not restricted to the above-described embodiments, and modifications, improvements, and the like can be adequately made.

The "active-energy ray" as used in the present invention is not particularly limited as long as its irradiation can impart energy capable of generating an initiation species in the ink composition, and widely includes α-ray, γ-ray, X-ray, ultraviolet ray, visible ray, electron beam and the like. Among these, in view of curing sensitivity and easy availability of the apparatus, ultraviolet ray and electron beam are preferred, and ultraviolet ray is more preferred. Accordingly, the ink composition for use in the present invention is preferably an ink composition which can be cured by the irradiation of ultraviolet ray.

In the active-energy ray curable ink-jet recording apparatus of the present invention, the peak wavelength of active-energy ray varies depending on the absorption characteristics of the sensitizing dye in the ink composition but is suitably, for example, from 200 to 600 nm, preferably from 300 to 450 nm, more preferably from 350 to 450 nm. Also, the (a) electron transfer-type initiation system of the ink composition for use in the present invention exhibits sufficiently high sensitivity even for low-output active-energy ray. Accordingly, the output of the active-energy ray used as the irradiation energy is suitably, for example, 2,000 mJ/cm$^2$ or less, preferably from 10 to 2,000 mJ/cm$^2$, more preferably from 20 to 1,000 mJ/cm$^2$, still more preferably from 50 to 800 mJ/cm$^2$. Also, the active-energy ray is suitably irradiated at an exposure surface illuminance (a maximum illuminance on the recording medium surface) of, for example, from 10 to 2,000 mW/cm$^2$, preferably from 20 to 1,000 mW/cm$^2$.

Particularly, in the active-energy ray curable ink-jet recording apparatus of the present invention, the active-energy ray is preferably irradiated from a light-emitting diode which can generate an ultraviolet ray having an emission wavelength peak of 390 to 420 nm and giving a maximum illuminance of 10 to 1,000 mW/cm$^2$ on the recording medium surface.

Also, in the active-energy ray curable ink-jet recording apparatus of the present invention, the active-energy ray suitably irradiates the ink composition ejected on a recording medium, for example, for 0.01 to 120 seconds, preferably from 0.1 to 90 seconds.

Furthermore, in the active-energy ray curable ink-jet recording apparatus of the present invention, it is preferred that the ink composition is heated to a fixed temperature and the time from the landing of ink composition on a recording medium to the irradiation of active-energy ray is set to 0.01 to 0.5 seconds, preferably from 0.02 to 0.3 seconds, more preferably from 0.03 to 0.15 seconds. By virtue of controlling the time from the landing of ink composition on a recording medium to the irradiation of active-energy ray to such a very short time, the ink composition landed can be prevented from bleeding before curing.

For obtaining a color image by using the active-energy ray curable ink-jet recording apparatus of the present invention, the colors are preferably superposed in the color value order from lower to higher. When superposed in such an order, the active-energy ray can readily reach the ink in the lower part and this can be expected to yield good curing sensitivity, reduction of residual monomer, decrease of odor and enhancement of adhesive property. As for the irradiation of active-energy ray, all colors may be ejected and en bloc exposed, but exposure is preferably performed every each color in view of accelerating the curing.

As described above, in the case of active-energy ray curable ink like the ink composition of the present invention, the ink composition ejected is preferably kept at a constant temperature and therefore, the temperature in the region from the ink supply tank to the ink-jet head portion is preferably controlled by heat insulation and heating. Also, the head unit is preferably heated by thermally shielding or insulating the apparatus body so as not to receive an effect from the temperature of outer air. In order to shorten the printer start-up time necessary for heating or reduce the loss of heat energy, in combination with thermal insulation from other sites, the heat capacity of the entire heating unit is preferably made small.

As for the active-energy ray source, a mercury lamp, a gas/solid laser and the like are principally utilized and for the ultraviolet curing-type ink-jet, a mercury lamp and a metal halide lamp are widely known. Furthermore, replacement by a GaN-based semiconductor ultraviolet light-emitting device is industrially and environmentally very useful. In addition, LED (UV-LED) and LD (UV-LD) are compact, long-lived, highly efficient and low costing and are promising as a radiation source for active-energy ray curable ink-jet.

As described above, a light-emitting diode (LED) and a laser diode (LD) can be used as the active-energy ray source. In particular, when an ultraviolet source is necessary, an ultraviolet LED or an ultraviolet LD can be used. For example, an ultraviolet LED of which main emission spectrum has a wavelength between 365 nm and 420 nm is commercially available from Nichia Corp. Also, when a further shorter wavelength is required, an LED capable of emitting active-energy ray having a primary emission between 300 nm and 370 nm is disclosed in U.S. Pat. No. 6,084,250. Other ultraviolet LEDs are also available, and radiations in different ultraviolet bands may be irradiated. The active-energy ray source for use in the present invention is preferably UV-LED, more preferably UV-LED having a peak wavelength in the region of 350 to 420 nm.

[Recording Medium]

The recording medium to which the ink composition of the present invention can be applied is not particularly limited and normal paper sheets such as non-coated paper and coated paper, and various non-absorptive resin materials and resin films shaped therefrom, which are used in so-called soft packaging, may be used. Examples of various plastic films include PET film, OPS film, OPP film, ONy film, PVC film, PE film and TAC film. Other examples of the plastic usable as the recording medium material include polycarbonate, acrylic resin, ABS, polyacetal, PVA and rubbers. Furthermore, metals and glasses may also be used as the recording medium.

In the ink composition of the present invention, when a material less causing heat shrinkage at curing is selected, excellent adhesive property is obtained between the cured ink composition and the recording medium and this is advantageous in that a high-definition image can be formed even on a film susceptible to curling or deformation due to, for example, curing shrinkage of ink or heat generation at the curing reaction, such as PET film, OPS film, OPP film, ONy film and PVC film which are thermally shrinkable.

The constituent components for use in the ink composition usable in the present invention are described below in sequence.

[Ink Composition]

The ink composition for use in the present invention is an ink composition capable of being cured by the irradiation of active-energy ray, and examples thereof include a cationic polymerization-type ink composition, a radical polymerization-type ink composition and an aqueous ink composition. These compositions are described in detail below.

(Cationic Polymerization-Type Ink Composition)

The cationic polymerization-type ink composition contains (a) a cationic polymerizable compound and (b) a compound capable of generating an acid upon irradiation with active-energy ray and if desired, may further contain a colorant, an ultraviolet absorbent, a sensitizer, an antioxidant, a discoloration inhibitor, electrically conducting salts, a solvent, a polymer compound, a surfactant and the like.

The constituent components used in the cationic polymerization-type ink composition are described below in sequence.

[(a) Cationic Polymerizable Compound]

The (a) cationic polymerizable compound for use in the present invention is not particularly limited as long as it is a compound capable of being cured by causing a polymerization reaction using an acid generated from the (b) compound capable of generating an acid upon irradiation with active-energy ray, and various known cationic polymerizable monomers known as a photo-cationic polymerizable monomer may be used. Examples of the cationic polymerizable monomer include epoxy compounds, vinyl ether compounds and oxetane compounds described in JP-A-6-9714, JP-A-2001-31992, JP-A-2001-40068, JP-A-2001-55507, JP-A-2001-310938, JP-A-2001-310937 and JP-A-2001-220526.

Examples of the epoxy compound include an aromatic epoxide, an alicyclic epoxide and an aliphatic epoxide.

The aromatic epoxide includes a di- or polyglycidyl ether produced by the reaction of a polyhydric phenol having at least one aromatic nucleus or an alkylene oxide adduct thereof with epichlorohydrin. Examples thereof include a di- or polyglycidyl ether of bisphenol A or an alkylene oxide adduct thereof, a di- or polyglycidyl ether of hydrogenated bisphenol A or an alkylene oxide adduct thereof, and a novolak-type epoxy resin. Examples of the alkylene oxide include an ethylene oxide and a propylene oxide.

As for the alicyclic epoxide, a cyclohexene oxide- or cyclopentene oxide-containing compound obtained by epoxidizing a compound having at least one cycloalkene ring such as cyclohexene or cyclopentene ring with an appropriate oxidizing agent such as hydrogen peroxide and peracid is preferred.

Examples of the aliphatic epoxide include a di- or polyglycidyl ether of an aliphatic polyhydric alcohol or an alkylene oxide adduct thereof. Representative examples thereof include a diglycidyl ether of an alkylene glycol, such as diglycidyl ether of ethylene glycol, diglycidyl ether of propylene glycol, and diglycidyl ether of 1,6-hexanediol; a polyglycidyl ether of a polyhydric alcohol, such as di- or triglycidyl ether of glycerin or an alkylene oxide adduct thereof; and a diglycidyl ether of a polyalkylene glycol, as represented by a diglycidyl ether of a polyethylene glycol or an alkylene oxide adduct thereof, and a diglycidyl ether of a polypropylene glycol or an alkylene oxide adduct thereof. Here, examples of the alkylene oxide include an ethylene oxide and a propylene oxide.

The epoxy compound may be monofunctional or polyfunctional.

Examples of the monofunctional epoxy compound which can be used in the present invention include phenyl glycidyl ether, p-tert-butylphenyl glycidyl ether, butyl glycidyl ether, 2-ethylhexyl glycidyl ether, allyl glycidyl ether, 1,2-butylene oxide, 1,3-butadiene monoxide, 1,2-epoxydodecane, epichlorohydrin, 1,2-epoxydecane, styrene oxide, cyclohexene oxide, 3-methacryloyloxymethyl-cyclohexene oxide, 3-acryloyloxymethylcyclohexene oxide and 3-vinylcyclohexene oxide.

Examples of the polyfunctional epoxy compound include bisphenol A diglycidyl ether, bisphenol F diglycidyl ether, bisphenol S diglycidyl ether, brominated bisphenol A diglycidyl ether, brominated bisphenol F diglycidyl ether, brominated bisphenol S diglycidyl ether, epoxy novolak resin, hydrogenated bisphenol A diglycidyl ether, hydrogenated bisphenol F diglycidyl ether, hydrogenated bisphenol S diglycidyl ether, 3,4-epoxycyclohexylmethyl-3',4'-epoxycyclohexane carboxylate, 2-(3,4-epoxycyclohexyl-5,5-spiro-3,4-epoxy)cyclohexane-meta-dioxane, bis(3,4-epoxycyclohexylmethyl) adipate, vinylcyclohexene oxide, 4-vinylepoxycyclohexane, bis(3,4-epoxy-6-methyl-cyclohexylmethyl)adipate, 3,4-epoxy-6-methylcyclohexyl-3',4'-epoxy-6'-methylcyclohexane carboxylate, methylenebis-(3,4-epoxycyclohexane), dicyclopentadiene diepoxide, di(3,4-epoxycyclohexylmethyl)ether of ethylene glycol, ethylenebis(3,4-epoxycyclohexane carboxylate), dioctyl epoxyhexahydrophthalate, di-2-ethylhexyl epoxyhexahydrophthalate, 1,4-butanediol diglycidyl ether, 1,6-hexanediol diglycidyl ether, glycerin triglycidyl ether, trimethylol-propane triglycidyl ether, polyethylene glycol diglycidyl ether, polypropylene glycol diglycidyl ethers, 1,1,3-tetradecadiene dioxide, limonene dioxide, 1,2,7,8-diepoxyoctane and 1,2,5,6-diepoxycyclooctane.

Among these epoxy compounds, an aromatic epoxide and an alicyclic epoxide are preferred in view of excellent curing rate, and an alicyclic epoxide is more preferred.

Examples of the vinyl ether compound include a di- or trivinyl ether compound such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexanedimethanol divinyl ether and trimethylolpropane trivinyl ether; and a monovinyl ether compound such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexanedimethanol monovinyl ether, n-propyl vinyl ether, isopropyl vinyl ether, isopropenyl ether-O-propylene carbonate, dodecyl vinyl ether, diethylene glycol monovinyl ether and octadecyl vinyl ether.

The vinyl ether compound may be monofunctional or polyfunctional.

Specifically, examples of the monofunctional vinyl ether include methyl vinyl ether, ethyl vinyl ether, propyl vinyl ether, n-butyl vinyl ether, tert-butyl vinyl ether, 2-ethylhexyl vinyl ether, n-nonyl vinyl ether, lauryl vinyl ether, cyclohexyl vinyl ether, cyclohexylmethyl vinyl ether, 4-methylcyclohexylmethyl vinyl ether, benzyl vinyl ether, dicyclopentenyl vinyl ether, 2-dicyclopentenoxyethyl vinyl ether, methoxyethyl vinyl ether, ethoxyethyl vinyl ether, butoxyethyl vinyl ether, methoxyethoxyethyl vinyl ether, ethoxyethoxyethyl vinyl ether, methoxypolyethylene glycol vinyl ether, tetrahydrofurfuryl vinyl ether, 2-hydroxyethyl vinyl ether, 2-hydroxypropyl vinyl ether, 4-hydroxybutyl vinyl ether, 4-hydroxymethylcyclohexylmethyl vinyl ether, diethylene glycol monovinyl ether, polyethylene glycol vinyl ether, chloroethyl vinyl ether, chlorobutyl vinyl ether, chloroethoxyethyl vinyl ether, phenylethyl vinyl ether and phenoxypolyethylene glycol vinyl ether.

Examples of the polyfunctional vinyl ether include divinyl ethers such as ethylene glycol divinyl ether, diethylene glycol divinyl ether, polyethylene glycol divinyl ether, propylene glycol divinyl ether, butylene glycol divinyl ether, hexanediol divinyl ether, bisphenol A alkylene oxide divinyl ether and bisphenol F alkylene oxide divinyl ether; and polyfunctional vinyl ethers such as trimethylolethane trivinyl ether, trimethylolpropane trivinyl ether, ditrimethylolpropane tetravinyl ether, glycerin trivinyl ether, pentaerythritol tetravinyl ether, dipentaerythritol pentavinyl ether, dipentaerythritol hexavinyl ether, ethylene oxide-added trimethylolpropane trivinyl ether, propylene oxide-added trimethylolpropane trivinyl ether, ethylene oxide-added ditrimethylolpropane tetravinyl ether, propylene oxide-added ditrimethylolpropane tetravinyl ether, ethylene oxide-added pentaerythritol tetravinyl ether, propylene oxide-added pentaerythritol tetravinyl ether, ethylene oxide-added dipentaerythritol hexavinyl ether and propylene oxide-added dipentaerythritol hexavinyl ether.

As for the vinyl ether compound, a di- or trivinyl ether compound is preferred in view of curing property, adhesion to recording medium, surface hardness of image formed, or the like, and a divinyl ether compound is more preferred.

The oxetane compound as referred to in the present invention indicates a compound having an oxetane ring, and known oxetane compounds described, for example, in JP-A-2001-220526, JP-A-2001-310937 and JP-A-2003-341217 may be arbitrarily selected and used.

The compound having an oxetane ring, which can be used in the ink composition of the present invention, is preferably a compound having from one to four oxetane rings in the structure thereof. When such a compound is used, the viscosity of the ink composition can be easily maintained in the range allowing for good handling, and high adhesion can be obtained between the ink composition after curing and the recording medium.

Such a compound having an oxetane ring is described in detail in paragraphs [0021] to [0084] of JP-A-2003-341217, and compounds described therein can be suitably used also in the present invention.

Out of the oxetane compounds for use in the present invention, a compound having one oxetane ring is preferably used in view of viscosity and tackiness of the ink composition.

In the ink composition of the present invention, one of these cationic polymerizable compounds may be used alone, or two or more species thereof may be used in combination, but from the standpoint of effectively controlling the shrinkage on curing the ink, at least one compound selected from oxetane compounds and epoxy compounds is preferably used in combination with a vinyl ether compound.

The content of the (a) cationic polymerizable compound in the ink composition is suitably from 10 to 95 weight %, preferably from 30 to 90 weight %, more preferably from 50 to 85 weight %, based on the entire solid content of the composition.

[(b) Compound Capable of Generating an Acid upon Irradiation with Active-Energy Ray]

The ink composition of the present invention contains a compound capable of generating an acid upon irradiation with active-energy ray (hereinafter appropriately referred to as a "photoacid generator").

The photoacid generator which can be used in the present invention may be appropriately selected from compounds capable of generating an acid upon irradiation with light (ultraviolet ray or far ultraviolet ray of 400 to 200 nm, preferably g-ray, h-ray, i-ray or KrF excimer laser light), ArF excimer laser light, electron beam, X-ray, molecular beam or ion beam, which are used in a photo-cationic polymerization photoinitiator, a photo-radical polymerization photoinitiator, a photo-decolorizing agent for coloring matters, a photo-discoloring agent, a micro resist or the like.

Examples of such a photoacid generator include an onium salt which decomposes upon irradiation with active-energy ray to generate an acid, such as diazonium salt, ammonium salt, phosphonium salt, iodonium salt, sulfonium salt, selenonium salt and arsonium salt; an organic halogen compound; an organic metal/organic halide; an o-nitrobenzyl type protective group-containing photoacid generator; a compound capable of undergoing photodecomposition to generate a sulfonic acid, as represented by imino sulfonate; a disulfone compound; a diazoketosulfone; and a diazodisulfone compound.

Furthermore, for example, oxazole derivatives and s-triazine derivatives described in paragraphs [0029] to [0030] of JP-A-2002-122994 may also be suitably used as the photoacid generator. In addition, onium salt compounds and sulfonate-based compounds described in paragraphs [0037] to [0063] of JP-A-2002-122994 may also be suitably used as the photoacid generator in the present invention.

As for the (b) photoacid generator, one species may be used alone or two or more species may be used in combination.

The content of the (b) photoacid generator in the ink composition is preferably from 0.1 to 20 weight %, more preferably from 0.5 to 10 weight %, still more preferably from 1 to 7 weight %, based on the entire solid content of the ink composition.

[Colorant]

The ink composition of the present invention can form a visible image by adding thereto a colorant. For example, in the case of forming an image region of a lithographic printing plate, a colorant need not be necessarily added, but in view of suitability for plate inspection of the obtained lithographic printing plate, use of a colorant is also preferred.

The colorant which can be used here is not particularly limited, and various known coloring materials (pigment, dye) may be appropriately selected and used according to the usage. For example, in the case of forming an image with excellent weather resistance, a pigment is preferred. As for the dye, both a water-soluble dye and an oil-soluble dye may be used, but an oil-soluble dye is preferred.

[Pigment]

The pigment which is preferably used in the present invention is described below.

The pigment is not particularly limited and, for example, all organic and inorganic pigments generally available on the market, those obtained by dispersing a pigment in a dispersion medium such as insoluble resin, and those obtained by grafting a resin to the pigment surface may be used. In addition, those obtained by, for example, dyeing a resin particle with a dye may also be used.

Examples of such a pigment include pigments described in Seishiro Ito (compiler), *Ganryo No Jiten* (*Pigment Dictionary*), published in 2000, W. Herbst and K. Hunger, *Industrial Organic Pigments*, JP-A-2002-12607, JP-A-2002-188025, JP-A-2003-26978 and JP-A-2003-342503.

Specific examples of the organic and inorganic pigments which can be used in the present invention are pigments wherein a pigment concentration of the ink is equal to or larger than 6 wt. % and smaller than 20 wt. %, and more specific examples are as follows. Examples of the pigment which provides a yellow color include a monoazo pigment such as C.I. Pigment Yellow 1 (e.g., Fast Yellow G) and C.I. Pigment Yellow 74; a disazo pigment such as C.I. Pigment Yellow 12 (e.g., Disazo Yellow AAA) and C.I. Pigment Yellow 17; a non-benzidine-based azo pigment such as C.I. Pigment Yellow 180; an azo lake pigment such as C.I. Pigment Yellow 100 (e.g., Tartrazine Yellow Lake); a condensed azo pigment such as C.I. Pigment Yellow 95 (e.g., Condensed Azo Yellow GR); an acidic dye lake pigment such as C.I. Pigment Yellow 115 (e.g., Quinoline Yellow Lake); a basic dye lake pigment such as C.I. Pigment Yellow 18 (e.g., Thioflavine Lake); an anthraquinone-based pigment such as Flavanthrone Yellow (Y-24); an isoindolinone pigment such as Isoindolinone Yellow 3RLT (Y-110); a quinophthalone pigment such as Quinophthalone Yellow (Y-138); an isoindoline pigment such as Isoindoline Yellow (Y-139); a nitroso pigment such as C.I. Pigment Yellow 153 (e.g., Nickel Nitroso Yellow); and a metal complex salt azomethine pigment such as C.I. Pigment Yellow 117 (e.g., Copper Azomethine Yellow).

Examples of the pigment which provides a red or magenta color include a monoazo-based pigment such as C.I. Pigment Red 3 (e.g., Toluidine Red); a disazo pigment such as C.I. Pigment Red 38 (e.g., Pyrazolone Red B); an azo lake pigment such as C.I. Pigment Red 53:1 (e.g., Lake Red C) and C.I. Pigment Red 57:1 (Brilliant Carmine 6B); a condensed azo pigment such as C.I. Pigment Red 144 (e.g., Condensed Azo Red BR); an acidic dye lake pigment such as C.I. Pigment Red 174 (e.g., Phloxine B Lake); a basic dye lake pigment such as C.I. Pigment Red 81 (e.g., Rhodamine 6G' Lake); an anthraquinone-based pigment such as C.I. Pigment Red 177 (e.g., Dianthraquinonyl Red); a thioindigo pigment such as C.I. Pigment Red 88 (e.g., Thioindigo Bordeaux); a perinone pigment such as C.I. Pigment Red 194 (e.g., Perinone Red); a perylene pigment such as C.I. Pigment Red 149 (e.g., Perylene Scarlet); a quinacridone pigment such as C.I. Pigment Violet 19 (unsubstituted quinacridone) and C.I. Pigment Red 122 (e.g., Quinacridone Magenta); an isoindolinone pigment such as C.I. Pigment Red 180 (e.g., Isoindolinone Red 2BLT); and an alizarin lake pigment such as C.I. Pigment Red 83 (e.g., Madder Lake).

Examples of the pigment which provides a blue or cyan color include a disazo-based pigment such as C.I. Pigment Blue 25 (e.g., Dianisidine Blue); a phthalocyanine pigment such as C.I. Pigment Blue 15 (e.g., Phthalocyanine Blue); an acidic dye lake pigment such as C.I. Pigment Blue 24 (e.g., Peacock Blue Lake); a basic dye lake pigment such as C.I. Pigment Blue 1 (e.g., Victoria Pure Blue BO Lake); an anthraquinone-based pigment such as C.I. Pigment Blue 60 (e.g., Indanthrone Blue); and an alkali blue pigment such as C.I. Pigment Blue 18 (Alkali Blue V-5:1).

Examples of the pigment which provides a green color include a phthalocyanine pigment such as C.I. Pigment Green 7 (Phthalocyanine Green) and C.I. Pigment Green 36 (Phthalocyanine Green); and an azo metal complex pigment such as C.I. Pigment Green 8 (Nitroso Green).

Examples of the pigment which provides an orange color include an isoindoline-based pigment such as C.I. Pigment Orange 66 (Isoindoline Orange); and an anthraquinone-based pigment such as C. I. Pigment Orange 51 (Dichloropyranthrone Orange).

Examples of the pigment which provides a black color include carbon black, titanium black and aniline black.

Specific examples of the white pigment which can be used include basic lead carbonate ($2PbCO_3Pb(OH)_2$, so-called "silver white"), zinc oxide (ZnO, so-called "zinc white"), titanium oxide ($TiO_2$, so-called "titanium white"), strontium titanate ($SrTiO_3$, so-called "titanium strontium white").

Here, titanium oxide has a low specific gravity and a high refractive index and is chemically and physically stable as compared with other white pigments and therefore, this pigment ensures that the masking power and coloring power as a pigment are high and the durability against acid, alkali and other environments is excellent. Because of this, titanium oxide is preferably used as the white pigment. As a matter of course, other white pigments (may also be a white pigment other than those described above) may be used, if desired.

The pigment may be dispersed by using a dispersing device such as ball mill, sand mill, attritor, roll mill, jet mill, homogenizer, paint shaker, kneader, agitator, Henschel mixer, colloid mill, ultrasonic homogenizer, pearl mill and wet jet mill.

When dispersing the pigment, a dispersant may also be added. Examples of the dispersant include a hydroxyl group-containing carboxylic acid ester, a salt of long-chain polyaminoamide with high molecular weight acid ester, a salt of high molecular weight polycarboxylic acid, a high molecular weight unsaturated acid ester, a polymer copolymerization product, a modified polyacrylate, an aliphatic polyvalent carboxylic acid, a naphthalenesulfonic acid formalin condensate, a polyoxyethylene alkylphosphoric ester and a pigment derivative. A commercially available polymer dispersant such as Solsperse Series of Zeneca Ltd. may also be preferably used.

In addition, a synergist according to various pigments may be used as a dispersion aid. The dispersant or dispersion aid is preferably added in an amount of 1 to 50 parts by weight per 100 parts by weight of the pigment.

In the ink composition, a solvent may be added as a dispersion medium for various components such as pigment, or the (a) cationic polymerizable compound which is a low molecular weight component may be used as a dispersion medium without using a solvent. However, since the ink composition of the present invention is an active-energy ray curable ink and the ink is applied onto a recording medium and then cured, the ink composition is preferably solvent-free. This is because when a solvent remains in the cured ink image, the solvent resistance may deteriorate or the residual solvent may cause a problem of VOC (volatile organic compound). From such a standpoint, the (a) cationic polymerizable compound is preferably used as the dispersion medium. Above all, in view of dispersion suitability or enhancement of handling property of the ink composition, a cationic polymerizable monomer having a lowest viscosity is preferably selected.

The average particle diameter of the pigment is preferably from 0.02 to 4 μm, more preferably from 0.02 to 2 μm, still more preferably from 0.02 to 1.0 μm.

The pigment, dispersant, dispersion medium and dispersion or filtration conditions are selected or set so that the pigment particle can have an average particle diameter in the above-described preferred range. By this control of the particle diameter, clogging of the head nozzle can be suppressed and the storage stability, transparency and curing sensitivity of ink can be maintained.

[Dye]

The dye for use in the present invention is preferably an oil-soluble dye. Specifically, the oil-soluble dye means a dye having a solubility in water at 25° C. (weight of the coloring matter dissolved in 100 g of water) of 1 g or less. The solubility is preferably 0.5 g or less, more preferably 0.1 g or less. Accordingly, a so-called water-insoluble oil-soluble dye is preferably used.

As regards the dye for use in the present invention, it is also preferred to introduce an oil-solubilizing group into the mother nucleus of the above-described dye for the purpose of dissolving a necessary amount of dye in the ink composition.

Examples of the oil-solubilizing group include a long-chain or branched alkyl group, a long-chain or branched alkoxy group, a long-chain or branched alkylthio group, a long-chain or branched alkylsulfonyl group, a long-chain or branched acyloxy group, a long-chain or branched alkoxycarbonyl group, a long-chain or branched acyl group, a long-chain or branched acylamino group, a long-chain or branched alkylsulfonylamino group, a long-chain or branched alkylaminosulfonyl group; and an aryl group, an aryloxy group, an aryloxycarbonyl group, an arylcarbonyloxy group, an arylaminocarbonyl group, an arylaminosulfonyl group and an arylsulfonylamino group, each containing the above-described long-chain or branched substituent.

Furthermore, the dye may be obtained from a water-soluble dye having a carboxyl acid or a sulfonic acid through conversion into an oil-solubilizing group, that is, an alkoxycarbonyl group, an aryloxycarbonyl group, an alkylaminosulfonyl group or an arylaminosulfonyl group, by using a long-chain or branched alcohol, an amine, a phenol or an aniline derivative.

The oil-soluble dye preferably has a melting point of 200° C. or less, more preferably 150° C. or less, still more preferably 100° C. By using an oil-soluble dye having a low melting point, crystal precipitation of the coloring matter in the ink composition is suppressed and the ink composition comes to have good storage stability.

Furthermore, for the purpose of improving resistance against fading, particularly against an oxidative substance such as ozone, or enhancing the curing property, the oxidation potential is preferably noble (high). For this reason, the oil-soluble dye for use in the present invention preferably has an oxidation potential of 1.0 V (vs SCE) or more. A higher oxidation potential is preferred, and the oxidation potential is more preferably 1.1 V (vs SCE) or more, still more preferably 1.15 V (vs SCE) or more.

As for the dye of yellow color, compounds having a structure represented by formula (Y-I) of JP-A-2004-250483 are preferred.

Dyes represented by formulae (Y-II) to (Y-IV) described in paragraph [0034] of JP-A-2004-250483 are more preferred. Specific examples thereof include compounds described in paragraphs [0060] to [0071] of JP-A-2004-250483. Incidentally, the oil-soluble dye of formula (Y-I) described in the patent publication above may be used not only for yellow ink but also for ink of any color, such as black ink and red ink.

As for the dye of magenta color, compounds having a structure represented by formula (3) or (4) described in JP-A-2002-114930 are preferred. Specific examples thereof include the compounds described in paragraphs [0054] to [0073] of JP-A-2002-114930.

Azo dyes represented by formulae (M-1) to (M-2) described in paragraphs [0084] to [0122] of JP-A-2002-121414 are more preferred, and specific examples thereof include the compounds described in paragraphs [0123] to [0132] of JP-A-2002-121414. Incidentally, the oil-soluble dyes of formulae (3), (4) and (M-1) to (M-2) described in these patent publications may be used not only for magenta ink but also for ink of any color, such as black ink and red ink.

As for the dye of cyan color, dyes represented by formulae (I) to (IV) of JP-A-2001-181547 and dyes represented by formulae (IV-1) to (IV-4) described in paragraphs [0063] to [0078] of JP-A-2002-121414 are preferred. Specific examples thereof include the compounds described in paragraphs [0052] to [0066] of JP-A-2001-181547 and the compounds described in paragraphs [0079] to [0081] of JP-A-2002-121414.

Phthalocyanine dyes represented by formulae (C-I) and (C-II) described in paragraphs [0133] to [0196] of JP-A-2002-121414 are more preferred, and the phthalocyanine dye represented by formula (C-II) is still more preferred. Specific examples thereof include the compounds described in paragraphs [0198] to [0201] of JP-A-2002-121414. Incidentally, the oil-soluble dyes of formulae (I) to (IV), (IV-1) to (IV-4), (C-I) and (C-II) may be used not only for cyan ink but also for ink of any color, such as black ink and green ink.

Such a colorant is preferably added in an amount of, in terms of the solid content, from 1 to 20 weight %, more preferably from 2 to 10 weight %, based on the ink composition.

In the ink composition of the present invention, in addition to the above-described essential components, various additives may be used in combination according to the purpose. These arbitrary components are described below.

[Ultraviolet Absorbent]

In the present invention, an ultraviolet absorbent may be used from the standpoint of giving an image enhanced in the weather resistance and prevented from fading.

Examples of the ultraviolet absorbent include benzotriazole-based compounds described in JP-A-58-185677, JP-A-61-190537, JP-A-2-782, JP-A-5-197075 and JP-A-9-34057; benzophenone-based compounds described in JP-A-46-2784, JP-A-5-194483 and U.S. Pat. No. 3,214,463; cinnamic acid-based compounds described in JP-B-48-30492 (the term "JP-B" as used herein means an "examined Japanese patent application"), JP-B-56-21141 and JP-A-10-88106; triazinebased compounds described in JP-A-4-298503, JP-A-8-53427, JP-A-8-239368, JP-A-10-182621 and JP-T-8-501291 (the term (the term "JP-T" as used herein means a "published Japanese translation of a PCT patent application"); compounds described in *Research Disclosure*, No. 24239; and compounds capable of absorbing ultraviolet ray to emit fluorescence, so-called fluorescent brightening agent, as represented by a stilbene-based compound and a benzoxazole-based compound.

The amount of the ultraviolet absorbent added is appropriately selected according to the purpose but is generally on the order of 0.5 to 15 weight % in terms of the solid content.

[Sensitizer]

In the ink composition of the present invention, if desired, a sensitizer may be added for the purpose of enhancing the acid generation efficiency of the photoacid generator and shifting the photosensitive wavelength to a long wavelength side. The sensitizer may be any sensitizer as long as it can sensitize the photoacid generator by an electron or energy transfer mechanism. Preferred examples thereof include an aromatic polycondensed ring compound such as anthracene, 9,10-dialkoxyanthracene, pyrene and perylene; an aromatic ketone compound such as acetophenone, benzophenone, thioxanthone and Michler's ketone; and a heterocyclic compound such as phenothiazine and N-aryloxazolidinone. The amount of the sensitizer added is appropriately selected according to the purpose but is generally from 0.01 to 1 mol %, preferably from 0.1 to 0.5 mol %, based on the photoacid generator.

[Antioxidant]

An antioxidant may be added for the purpose of enhancing the stability of the ink composition. Examples of the antioxidant include those described in EP-A-223739, EP-A-309401, EP-A-309402, EP-A-310551, EP-A-310552, EP-A-459416, German Unexamined Patent Publication No. 3435443, JP-A-54-48535, JP-A-62-262047, JP-A-63-113536, JP-A-63-163351, JP-A-2-262654, JP-A-2-71262, JP-A-3-121449, JP-A-5-61166, JP-A-5-119449, and U.S. Pat. Nos. 4,814,262 and 4,980,275.

The amount of the antioxidant added is appropriately selected according to the purpose but is generally on the order of 0.1 to 8 weight % in terms of the solid content.

[Anti-Fading Agent]

In the ink composition of the present invention, various organic or metal complex-based anti-fading agents may be used. Examples of the organic anti-fading agent include hydroquinones, alkoxyphenols, dialkoxyphenols, phenols, anilines, amines, indanes, chromans, alkoxy-anilines and heterocyclic compounds. Examples of the metal complex-based anti-fading agent include a nickel complex and a zinc complex, and specifically, there may be used the compounds described in patents cited in *Research Disclosure*, No. 17643, No. VII, Items I to J, ibid., No. 15162, ibid., No. 18716, page 650, left column, ibid., No. 36544, page 527, ibid., No. 307105, page 872, and ibid., No. 15162; and the compounds included in formulae of representative compounds and in examples of the compounds describe on JP-A-62-215272, pp. 127-137.

The amount of the anti-fading agent added is appropriately selected according to the purpose but is generally on the order of 0.1 to 8 weight % in terms of the solid content.

[Electrically Conducting Salts]

In the ink composition of the present invention, electrically conducting salts such as potassium thiocyanate, lithium nitrate, ammonium thiocyanate and dimethylamine hydrochloride may be added for the purpose of controlling the ejection physical property.

[Solvent]

In the ink composition of the present invention, addition of an organic solvent in an extremely small amount is also effective for the purpose of improving the adhesion to a recording medium.

Examples of the solvent include a ketone-based solvent such as acetone, methyl ethyl ketone and diethyl ketone; an alcohol-based solvent such as methanol, ethanol, 2-propanol, 1-propanol, 1-butanol and tert-butanol; a chlorine-based solvent such as chloroform and methylene chloride; an aromatic solvent such as benzene and toluene; an ester-based solvent such as ethyl acetate, butyl acetate and isopropyl acetate; an ether-based solvent such as diethyl ether, tetrahydrofuran and dioxane; and a glycol ether-based solvent such as ethylene glycol monomethyl ether and ethylene glycol dimethyl ether.

In this case, addition in the range of not causing a problem in the solvent resistance or VOC is effective, and this amount is preferably from 0.1 to 5 weight %, more preferably from 0.1 to 3 weight %, based on the entire ink composition.

[Polymer Compound]

In the ink composition of the present invention, various polymer compounds may be added for the purpose of adjusting the film physical properties. Examples of the polymer compound which can be used include an acryl-based polymer, a polyvinyl butyral resin, a polyurethane resin, a polyamide resin, a polyester resin, an epoxy resin, a phenol resin, a polycarbonate resin, a polyvinyl butyral resin, a polyvinyl formal resin, a shellac, a vinyl-based resin, an acryl-based resin, a rubber-based resin, waxes and other natural resins. Also, two or more species thereof may be used in combination. Among these, a vinyl-based copolymer obtainable by the copolymerization of an acryl-based monomer is preferred. In addition, as for the copolymerization composition of the polymer binder, a copolymer containing, as the structural unit, a "carboxyl group-containing monomer", an "alkyl methacrylate" or an "alkyl acrylate" is also preferably used.

[Surfactant]

In the ink composition of the present invention, a surfactant may also be added.

The surfactant includes those described in JP-A-62-173463 and JP-A-62-183457. Examples thereof include an anionic surfactant such as dialkylsulfosuccinates, alkylnaphthalenesulfonates and fatty acid salts; a nonionic surfactant such as polyoxyethylene alkyl ethers, polyoxyethylene alkylallyl ethers, acetylene glycols and polyoxyethylene-polyoxypropylene block copolymers; and a cationic surfactant such as alkylamine salts and quaternary ammonium salts. Incidentally, an organic fluoro compound may be used in place of the surfactant above. The organic fluoro compound is preferably hydrophobic. Examples of the organic fluoro compound include a fluorine-containing surfactant, an oily fluorine-containing compound (e.g., fluorine oil), a solid fluorine compound resin (e.g., tetrafluoroethylene resin), and those described in JP-B-57-9053 (columns 8 to 17) and JP-A-62-135826.

Other than these, for example, a leveling additive, a matting agent, waxes for adjusting the film physical properties, and a tackifier for improving adhesion to a recording medium such as polyolefin and PET, which does not inhibit the polymerization, may be added, if desired.

Specific examples of the tackifier include high molecular weight adhesive polymers described in JP-A-2001-49200, pp. 5-6 (for example, a copolymer comprising an ester of a (meth)acrylic acid and an alcohol containing an alkyl group having a carbon number of 1 to 20, an ester of a (meth)acrylic acid and an alicyclic alcohol having a carbon number of 3 to 14, or an ester of a (meth)acrylic acid and an aromatic alcohol having a carbon number of 6 to 14); and a low molecular weight tackifier resin having a polymerizable unsaturated bond.

[Radical Polymerization-Type Ink Composition]

The radical polymerization-type ink composition contains (d) a radical polymerizable compound, (e) a polymerization initiator and, if desired, may further contain a colorant, a sensitizing dye, a co-sensitizer and the like.

The constituent components used in the radical polymerization-type ink composition are described below in sequence.

(d) [Radical Polymerizable Compound]

The radical polymerizable compound includes, for example, the following compound having an addition-polymerizable ethylenically unsaturated bond.

[Compound Having Addition-Polymerizable Ethylenically Unsaturated Bond]

Examples of the compound having an addition-polymerizable ethylenically unsaturated bond, which can be used in the ink composition of the present invention, include an ester of an unsaturated carboxylic acid (e.g., acrylic acid, methacrylic acid, itaconic acid, crotonic acid, isocrotonic acid, maleic acid) and an aliphatic polyhydric alcohol compound, and an amide of the above-described unsaturated carboxylic acid and an aliphatic polyvalent amine compound.

Specific examples of the ester monomer of an aliphatic polyhydric alcohol compound and an unsaturated carboxylic acid include the followings. Examples of the acrylic ester include ethylene glycol diacrylate, triethylene glycol diacrylate, 1,3-butanediol diacrylate, tetramethylene glycol diacrylate, propylene glycol diacrylate, neopentyl glycol diacrylate, trimethylolpropane triacrylate, trimethylolpropane tri(acryloyloxypropyl)ether, trimethylolethane triacrylate, hexanediol diacrylate, 1,4-cyclohexanediol diacrylate, tetraethylene glycol diacrylate, pentaerythritol diacrylate, pentaerythritol triacrylate, pentaerythritol tetraacrylate, dipentaerythritol diacrylate, dipentaerythritol hexaacrylate, sorbitol triacrylate, sorbitol tetraacrylate, sorbitol pentaacrylate, sorbitol hexaacrylate, tri(acryloyloxyethyl)isocyanurate, and polyester acrylate oligomer.

Examples of the methacrylic acid ester include tetramethylene glycol dimethacrylate, triethylene glycol dimethacrylate, neopentyl glycol dimethacrylate, trimethylolpropane trimethacrylate, trimethylolethane trimethacrylate, ethylene glycol dimethacrylate, 1,3-butanediol dimethacrylate, hexanediol dimethacrylate, pentaerythritol dimethacrylate, pentaerythritol trimethacrylate, pentaerythritol tetramethacrylate, dipentaerythritol dimethacrylate, dipentaerythritol hexamethacrylate, sorbitol trimethacrylate, sorbitol tetramethacrylate, bis[p-(3-methacryloxy-2-hydroxypropoxy)-phenyl]dimethylmethane, and bis[p-(acryloxyethoxy)phenyl]-dimethylmethane. Examples of itaconic acid ester include ethylene glycol diitaconate, propylene glycol diitaconate, 1,3-butanediol diitaconate, 1,4-butanediol diitaconate, tetramethylene glycol diitaconate, pentaerythritol diitaconater and sorbitol tetraitaconate.

Examples of the crotonic acid ester include ethylene glycol dicrotonate, tetramethylene glycol dicrotonate, pentaerythritol dicrotonate, and sorbitol tetradicrotonate.

Examples of the isocrotonic acid ester include ethylene glycol diisocrotonate, pentaerythritol diisocrotonate and sorbitol tetraisocrotonate. Examples of the maleic acid ester include ethylene glycol dimaleate, triethylene glycol dimaleate, pentaerythritol dimaleate and sorbitol tetramaleate. In addition, a mixture of these ester monomers may also be used. Specific examples of the amide monomer of an aliphatic polyvalent amine compound and an unsaturated carboxylic acid include methylenebis-acrylamide, methylenebis-methacrylamide, 1,6-hexamethylenebis-acrylamide, 1,6-hexamethylenebis-methacrylamide, diethylene triamine trisacrylamide, xylylenebisacrylamide, and xylylenebismethacrylamide.

Other examples include a vinyl urethane compound containing two or more polymerizable vinyl groups within one molecule, which is obtained by adding a hydroxyl group-containing vinyl monomer represented by the following formula (A) to a polyisocyanate compound containing two or more isocyanate groups within one molecule, described in JP-B-48-41708. $CH_2{=}C(R)COOCH_2CH(R')OH$(A) (wherein R and R' each represents H or $CH_3$).

Still other examples include a functional acrylate or methacrylate such as urethane acrylates described in JP-A-51-37193, polyester acrylates described in JP-A-48-64183, JP-B-49-43191 and JP-B-52-30490, and epoxy acrylates obtained by reacting an epoxy resin and a (meth)acrylic acid. Furthermore, those described as a photocurable monomer or oligomer in *Journal of the Adhesion Society of Japan*, Vol. 20, No. 7, pp. 300-308 (1984) may also be used. In the present invention, these monomers can be used in a chemical form such as a prepolymer, namely, dimer, trimer or oligomer, or a mixture or copolymer thereof.

The amount of the radical polymerizable compound used is usually from 1 to 99.99%, preferably from 5 to 90.0%, more preferably from 10 to 70% ("%" as used herein indicates "weight %"), based on all components of the ink composition.

(e) [Photopolymerization Initiator]

The photopolymerization initiator for use in the radical polymerization-type ink composition of the present invention is described below.

The photopolymerization initiator as used in the present invention indicates a compound capable of undergoing a chemical change under the action of light or through interaction with the electron excited state of a sensitizing dye and thereby producing at least one species of a radical, an acid and a base.

Preferred examples of the photopolymerization initiator include (i) aromatic ketones, (ii) an aromatic onium salt compound, (iii) an organic peroxide, (iv) a hexaarylbiimidazole compound, (v) a ketoxime ester compound, (vi) a borate compound, (vii) an azinium compound, (viii) a metallocene compound, (vix) an active ester compound, and (x) a carbon-halogen bond-containing compound.

[Colorant]

A colorant the same as those described for the colorant regarding the cationic polymerization-type ink composition may be utilized.

In the ink composition of the present invention, in addition to the above-described essential components, various additives may be used in combination according to the purpose. These arbitrary components are described below.

[Sensitizing Dye]

In the present invention, a sensitizing dye may be added for the purpose of improving the sensitivity of the photopolymerization initiator. Preferred examples of the sensitizing dye include those belonging to the following compounds and having an absorption wavelength in the region from 350 to 450 nm.

That is, the compounds are polynuclear aromatics (e.g., pyrene, perylene, triphenylene), xanthenes (e.g., fluorescein, eosin, erythrosin, Rhodamine B, Rose Bengale), cyanines (e.g., thiacarbocyanine, oxacarbocyanine), merocyanines (e.g., merocyanine, carbomerocyanine), thiazines (e.g., thionine, Methylene Blue, Toluidine Blue), acridines (e.g., Acridine Orange, chloroflavin, acriflavine), anthraquinones (e.g., anthraquinone), squaryliums (e.g., squarylium), and coumarins (e.g., 7-diethylamino-4-methyl-coumarin).

[Co-Sensitizer]

Furthermore, in the ink of the present invention, a known compound having an activity of, for example, more enhancing the sensitivity or suppressing the polymerization inhibition by oxygen may be added as a co-sensitizer.

Examples of such a co-sensitizer include amines such as compounds described in M. R. Sander, et al., *Journal of Polymer Society*, Vol. 10, page 3173 (1972), JP-B-44-20189, JP-A-51-82102, JP-A-52-134692, JP-A-59-138205, JP-A-60-84305, JP-A-62-18537, JP-A-64-33104, and *Research Disclosure*, No. 33825. Specific examples thereof include triethanolamine, ethyl p-dimethylaminobenzoate, p-formyldimethylaniline and p-methylthiodimethylaniline.

Other examples include thiols and sulfides such as thiol compounds described in JP-A-53-702, JP-B-55-500806, and JP-A-5-142772 and disulfide compounds described in JP-A-56-75643. Specific examples thereof include 2-mercaptobenzothiazole, 2-mercaptobenzoxazole, 2-mercaptobenzimidazole, 2-mercapto-4(3H)-quinazoline and β-mercaptonaphthalene.

Still other examples include an amino acid compound (e.g., N-phenylglycine), organometallic compounds described in JP-B-48-42965 (e.g., tributyltin acetate), hydrogen donors described in JP-B-55-34414, sulfur compounds described in JP-A-6-308727 (e.g., trithian), phosphorus compounds described in JP-A-6-250387 (e.g., diethyl phosphite), and Si—H and Ge—H compounds described in Japanese Patent Application No. 6-191605.

Also, in view of enhancing the storability, a polymerization inhibitor is preferably added in an amount of 200 to 20,000 ppm. The ink for ink-jet recording of the present invention is preferably ejected after heating it in the range from 40 to 80° C. and thereby decreasing the viscosity, and also for preventing head clogging due to thermal polymerization, addition of a polymerization inhibitor is preferred. Examples of the polymerization inhibitor include hydroquinone, benzoquinone, p-methoxyphenol, TEMPO, TEMPOL and cupferron Al.

[Others]

In addition, known compounds may be used as needed. For example, a surfactant, a leveling additive, a matting agent and, for adjusting the film physical properties, a polyester-based resin, a polyurethane-based resin, a vinyl-based resin, an acryl-based resin, a rubber-based resin or waxes, may be appropriately selected and used. Furthermore, in order to improve the adhesion to a recording medium such as polyolefin and PET, a tackifier which does not inhibit the polymerization is also preferably contained. Specific examples thereof include high molecular weight adhesive polymers described in JP-A-2001-49200, pp. 5-6 (for example, a copolymer comprising an ester of a (meth)acrylic acid and an alcohol containing an alkyl group having a carbon number of 1 to 20, an ester of a (meth)acrylic acid and an alicyclic alcohol having a carbon number of 3 to 14, or an ester of a (meth)acrylic acid and an aromatic alcohol having a carbon number of 6 to 14); and a low molecular weight tackifier resin having a polymerizable unsaturated bond.

Also, addition of an organic solvent in an extremely small amount is effective for the purpose of improving adhesion to a recording medium. In this case, addition in the range of not causing a problem in the solvent resistance or VOC is effective, and this amount is preferably from 0.1 to 5 weight %, more preferably from 0.1 to 3 weight %, based on the entire ink composition.

Furthermore, as the means for preventing reduction in the sensitivity due to light-shielding effect of the coloring material in the ink, it is also one preferred embodiment to form a radical/cation hybrid-type curing ink by combining a cationic polymerizable monomer having a long life as the polymerization initiator with a polymerization initiator.

[Aqueous Ink Composition]

The aqueous ink composition contains a polymerizable compound and a water-soluble photopolymerization initiator capable of generating a radical under the action of active-energy ray and if desired, may further contain a coloring material and the like.

[Polymerizable Compound]

As for the polymerizable compound contained in the aqueous ink composition of the present invention, a polymerizable compound contained in known aqueous ink compositions may be used.

In the aqueous ink composition, a reactive material may be added so as to optimize the formulation by taking into account end user characteristics such as curing rate, adhesion and flexibility. For example, a (meth)acrylate (namely, acrylate and/or methacrylate) monomer or oligomer, an epoxide and an oxetane are used as such a reactive material.

Examples of the acrylate monomer include a phenoxyethyl acrylate, an octyldecyl acrylate, a tetrahydrofuryl acrylate, an isobornyl acrylate, a hexanediol diacrylate, a trimethylolpropane triacrylate, a pentaerythritol triacrylate, a polyethylene glycol diacrylate (e.g., tetraethylene glycol diacrylate), a dipropylene glycol diacrylate, a tri(propylene glycol)triacrylate, a neopentyl glycol diacrylate, a bis(pentaerythritol)hexaacrylate, an acrylate of ethoxylated or propoxylated glycol and polyol (e.g., propoxylated neopentyl glycol diacrylate, ethoxylated trimethylolpropane triacrylate), and a mixture thereof.

Examples of the acrylate oligomer include an ethoxylated polyethylene glycol, an ethoxylated trimethylolpropane acrylate, a polyether acrylate including its ethoxylated product, and a urethane acrylate oligomer.

Examples of the methacrylate include a hexanediol dimethacrylate, a trimethylolpropane trimethacrylate, a triethylene glycol dimethacrylate, a diethylene glycol dimethacrylate, an ethylene glycol dimethacrylate, a 1,4-butanediol dimethacrylate, and a mixture thereof.

The amount of the oligomer added is preferably from 1 to 80 wt %, more preferably from 1 to 10 wt %, based on the entire weight of the ink composition.

[Water-Soluble Photopolymerization Initiator Capable of Producing a Radical Under the Action of Active-Energy Ray]

The polymerization initiator which can be used in the ink composition of the present invention is described below. As one example, a photopolymerization initiator up to a wavelength of around 400 nm may be used. Examples of such a photopolymerization initiator include photopolymerization initiators represented by the following formulae, which are a substance having functionality in a long wavelength region, namely, sensitivity of producing a radical when irradiated with ultraviolet rays (hereinafter simply referred to as a "TX system"). In the present invention, particularly, a photopolymerization initiator appropriately selected from these is preferably used.

TX-1

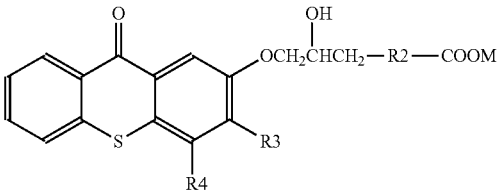

TX-2

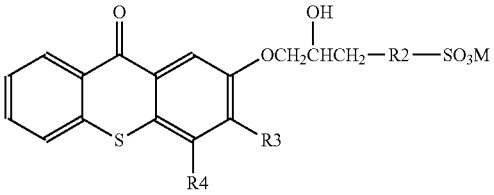

TX-3

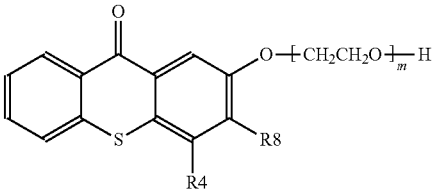

In formulae TX-1 to TX-3, R2 represents —$(CH_2)_x$— (wherein x is 0 or 1), —O—$(CH_2)_y$— (wherein y is 1 or 2), or a substituted or unsubstituted phenylene group. When R2 is a phenylene group, at least one of the hydrogen atoms in the benzene ring may be substituted by one group or atom or two or more groups or atoms selected from, for example, a carboxyl group or a salt thereof, a sulfonic acid or a salt thereof, a linear or branched alkyl group having a carbon number of 1 to 4, a halogen atom (e.g., fluorine, chlorine, bromine), an alkoxyl group having a carbon number of 1 to 4, and an aryloxy group such as phenoxy group. M represents a hydrogen atom or an alkali metal (e.g., Li, Na, K). R3 and R4 each independently represents a hydrogen atom or a substituted or unsubstituted alkyl group. Examples of the alkyl group include a linear or branched alkyl group having a carbon number of approximately from 1 to 10, particularly, a carbon number of approximately from 1 to 3. Examples of the substituent for this alkyl group include a halogen atom (e.g., fluorine, chlorine, bromine), a hydroxyl group, and an alkoxyl group (having a carbon number of approximately from 1 to 3). m represents an integer of 1 to 10.

In the present invention, a water-soluble derivative of a photopolymerization initiator, Irgacure 2959 (trade name, produced by Ciba Specialty Chemicals), represented by the following formula (hereinafter simply referred to as an "IC system") may be used. Specifically, IC-1 to IC-3 of the following formulae may be used.

Formula:

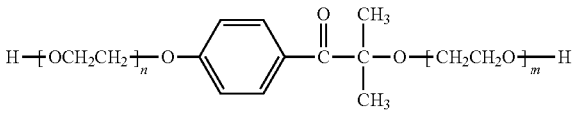

(n = 2~5, m = 0~5)

-continued

IC-1

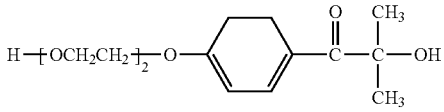

IC-2

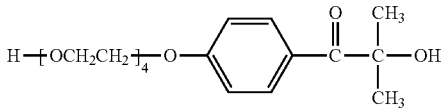

IC-3

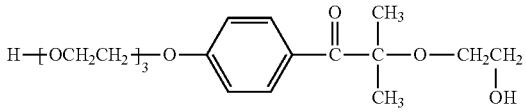

[Formulation for Clear Ink]

By using the water-soluble polymerizable compound in the form of a transparent aqueous ink without incorporating the above-described coloring material, a clear ink can be prepared. In particular, when the ink is prepared to have ink-jet recording property, an aqueous photocuring-type clear ink for ink-jet recording is obtained. This ink contains no coloring material and therefore, a clear film can be obtained by using the ink. Examples of the usage of the coloring material-free clear ink include use as an undercoat for imparting suitability for image printing to a recording material, and use as an overcoat for protecting the surface of an image formed by a normal ink or further imparting decoration, gloss or the like. In the clear ink, a colorless pigment, a fine particle or the like not for the purpose of coloration may be incorporated by dispersion according to the usage above. By this addition, various properties such as image quality, fastness and processability (handling property) of a printed matter can be enhanced in both cases of undercoat and overcoat.

As for the formulation conditions in such application to a clear ink, the ink is preferably prepared to contain a water-soluble polymerizable compound as the main component of the ink in a proportion of 10 to 85% and a photopolymerization initiator (for example, an ultraviolet polymerization catalyst) in an amount of 1 to 10 parts by weight per 100 parts by weight of the water-soluble polymerizable compound and at the same time, contain a photopolymerization initiator in an amount of at least 0.5 parts per 100 parts of the ink.

[Material Construction in Coloring Material-Containing Ink]

In the case of using the water-soluble polymerizable compound for a coloring material-containing ink, the concentrations of the polymerization initiator and polymerizable substance in the ink are preferably adjusted according to the absorption characteristics of the coloring material contained. As described above, the blending amount is set such that the amount of water or solvent is, on the weight basis, from 40 to 90%, preferably from 60 to 75%. Also, the content of the polymerizable compound in the ink is set to, on the weight basis, from 1 to 30%, preferably from 5 to 20%, based on the entire amount of the ink. The amount of the polymerization initiator depends on the content of the polymerizable compound but is generally, on the weight basis, from 0.1 to 7%, preferably from 0.3 to 5%, based on the entire amount of the ink.

In the case where a pigment is used as the coloring material of the ink, the concentration of the pure pigment portion in the ink is generally from 0.3 to 10 weight % based on the entire amount of the ink. The coloring power of the pigment depends on the dispersed state of pigment particles, but when the concentration is approximately from 0.3 to 1%, this is in the range of use as a light color ink, whereas the value exceeding the range above gives a concentration employed for normal coloration.

[Preferred Physical Properties of Ink Composition]

Taking into account the ejection property, the ink composition of the present invention preferably has an ink viscosity of 20 mPa·s or less, more preferably 10 mPa·s or less, at the ejection temperature, and an appropriate compositional ratio is preferably determined to give an ink viscosity in this range.

The surface tension in common of the ink composition of the present invention is preferably from 20 to 40 mN/m, more preferably from 25 to 35 mN/m. In the case of recording an image on various recording mediums such as polyolefins, PET, coated paper and non-coated paper, the surface tension is preferably 20 mN/m or more in view of bleeding and penetration and is preferably 40 mN/m or less in view of wettability.

The thus-prepared ink composition of the present invention is suitably used as an ink for ink-jet recording. In the case of using the ink composition as an ink for ink-jet recording, the ink composition is ejected on a recording medium by an ink-jet printer and the ink composition ejected is then cured by irradiating thereon active-energy ray, whereby recording is performed.

The printed matter obtained using this ink has an image area cured by the irradiation of active-energy ray such as ultraviolet ray and is assured of excellent strength of the image area and therefore, the ink composition can be used for various uses such as formation of an ink-receiving layer (image area) of a lithographic printing plate, other than the formation of an image.

Next, the undercoating liquid used in the clear ink layer which is to be applied onto the recording medium S will be described.

In the invention, "semi-curing" means partial curing, or a state where an undercoating liquid and/or an ink liquid is partially cured but not completely cured. In the case where an undercoating liquid applied onto a recording medium (hereinafter, referred to as a substrate) or an ink liquid ejected onto an undercoating liquid is semi-cured, the degree of curing may be inhomogeneous. For example, it is preferable that curing of an undercoating liquid and/or an ink liquid advances in the depth direction.

In the case where a radical polymerizable undercoating liquid and/or ink liquid is used in the air or in air which is partially substituted with an inert gas, there is a tendency that radical polymerization is inhibited on the surface of the undercoating layer or the undercoating liquid by the radical polymerization inhibition action of oxygen. As a result, inhomogeneous semi-curing is performed, and the curing more advances inside the undercoating layer or the ink liquid, thereby causing a tendency that curing of the surface is delayed.

Also in the case where a cation polymerizable undercoating liquid and/or ink liquid is used in damp air, the curing more advances inside the undercoating layer or the ink liquid because of the cation polymerization inhibition action of moisture, thereby causing a tendency that curing of the surface is delayed.

In the invention, when radical photopolymerizable undercoating liquid and/or ink liquid is used in coexistence of oxygen in which radical polymerization is inhibitory, and partially photocured, the degree of cure of the inner side of the undercoating liquid and/or the ink liquid is higher than that of the outer side.

When droplets of an ink liquid are deposited onto a semi-cured undercoating liquid, or when droplets of an ink liquid are deposited onto a semi-cured ink liquid of a different hue, a favorable technical effect is produced in the quality of an obtained printed matter. The function mechanism can be checked through cross-section observation of a printed matter.

Figure 3:
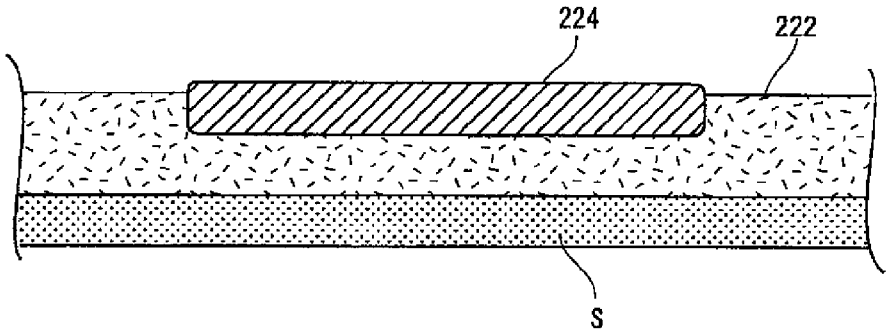
FIG. 3 is a sectional diagram of a printed matter which is obtained by depositing droplets of an ink liquid onto an undercoating liquid in a semi-cured state.

FIG. 3 is a sectional diagram of a printed matter which is obtained by depositing droplets of an ink liquid onto an undercoating liquid in a semi-cured state.

A high-concentration portion obtained in the case where ink liquid droplets of about 12 pL are deposited onto a semi-cured undercoating liquid 222 having a thickness of about 5 μm disposed on a substrate S will be described as an example.

Referring to the figure, the undercoating liquid 222 is semi-cured, and the degree of cure of a portion of the liquid on the side of the substrate S is higher than that of a surface layer. In this case, the following three features are observed. The features are (1) part of the ink liquid 224 is exposed from the surface, (2) part of the ink liquid 224 sinks into the undercoating liquid 222, and (3) the undercoating liquid 222 exists between the lower side of the ink liquid 224 and the substrate S. Namely, the printed matter which is obtained by giving the ink liquid 224 onto the semi-cured undercoating liquid 222 has a section as schematically shown in FIG. 3. When states (1), (2), and (3) above are satisfied, it is said that the ink liquid 224 is given to the semi-cured undercoating liquid 222. In this case, ink droplets which are densely deposited are connected to one another to form an ink film 224, so that high color density and chroma saturation are uniformly given.

Figure 4A:
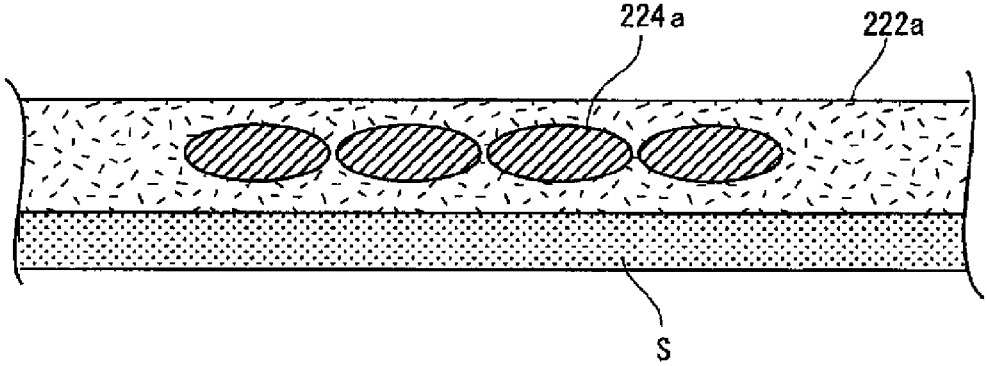
FIGS. 4A and 4B are sectional diagrams of a printed matter which is obtained by depositing droplets of an ink liquid 224*a* onto an undercoating liquid 222*a* in an uncured state.
Figure 4B:
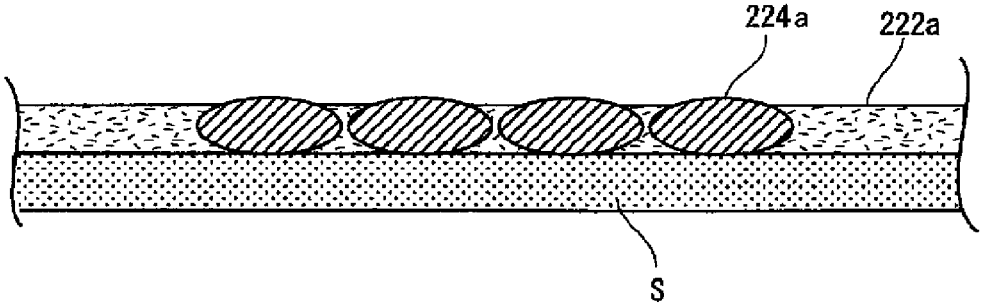

By contrast, FIGS. 4A and 4B are sectional diagrams of a printed matter which is obtained by depositing droplets of an ink liquid 224*a* onto an undercoating liquid 222*a* in an uncured state.

When droplets of the ink liquid 224*a* are deposited onto the undercoating liquid 222*a* in an uncured state, all of the ink liquid 224*a* sinks into the undercoating liquid 222*a* (FIG. 4A), and/or the undercoating liquid 222*a* does not exist below the ink liquid 224*a* (FIG. 4B). In this case, even when the ink liquid 224*a* is given in high density, droplets are independent from one another, and hence this causes the color concentration to be lowered.

Figure 5:
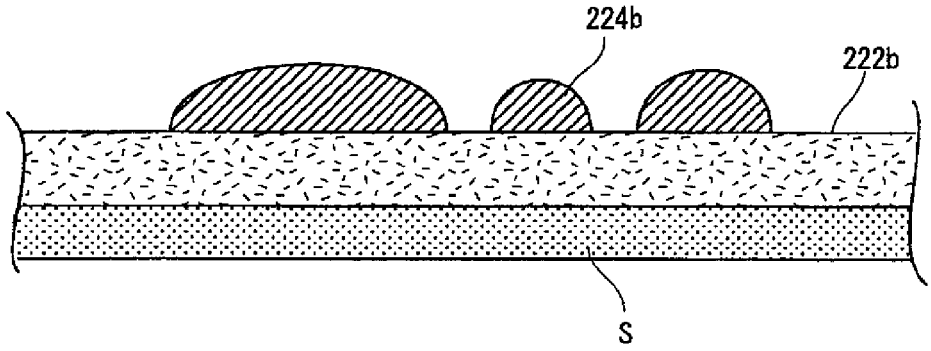
FIG. 5 is a sectional diagram of a printed matter which is obtained by depositing droplets of an ink liquid 224*b* onto an undercoating liquid 222*b* in a completely cured state.

FIG. 5 is a sectional diagram of a printed matter which is obtained by depositing droplets of an ink liquid 224*b* onto an undercoating liquid 222*b* in a completely cured state.

When droplets of the ink liquid 224*b* are deposited onto the completely cured undercoating liquid 222*b*, the ink liquid 224*b* does not sink into the undercoating liquid 222*b*. This state causes deposition interference to be produced, so that a uniform ink liquid film layer cannot be formed and the color reproducibility is lowered.

From the viewpoints that, when droplets of an ink liquid are given in high density, a uniform ink liquid layer is formed without causing the droplets to be independent from one another, and that production of deposition interference is suppressed, preferably, the quantity of an uncured portion of the undercoating liquid per unit area is sufficiently smaller than the maximum liquid droplet quantity of the ink liquid to be given per unit area. Namely, the relationship between the weight M (undercoating liquid) of an uncured portion of the undercoating liquid layer per unit area and the maximum weight m (ink liquid) of an ink liquid ejected per unit area is preferably "m (ink liquid)/30<M (undercoating liquid)<m (ink liquid)", more preferably "m (ink liquid)/20<M (undercoating liquid)<m (ink liquid)/3", and particularly preferably "m (ink liquid)/10<M (undercoating liquid)<m (ink liquid)/

5". In the relationship, the maximum weight of an ink liquid ejected per unit area is that of each color.

When m (ink liquid)/20≧M (undercoating liquid), deposition interference is produced, and the reproducibility of the dot size is caused to be lowered. Therefore, this is not preferable. When M (undercoating liquid)≧m (ink liquid), a uniform layer of an ink liquid cannot be formed, and there is a possibility that the concentration is lowered. Therefore, this is not preferable.

The weight of an uncured portion of the undercoating liquid layer per unit area was obtained by the transfer test described below. After the semi-curing process (for example, after irradiation of an active-energy ray) and before droplets of an ink liquid are deposited, a permeation medium such as plain paper is pressed against an undercoating liquid layer in a semi-cured state, and the weight of an undercoating liquid quantity transferred to the permeation medium is measured, whereby the uncured portion weight is defined.

For example, it is assumed that the maximum ejection quantity of an ink liquid is 12 pL (pico liters) per pixel when the deposited droplet density is 600×600 dpi. The maximum weight m (ink liquid) of an ink liquid ejected per unit area is 0.04 g/cm$^2$ (when the density of the ink liquid is assumed to be about 1.1 g/cm$^3$). Therefore, a preferred weight of an uncured portion of the undercoating liquid layer is larger than 0.0013 g/cm$^2$ per unit area and smaller than 0.04 g/cm$^2$, more preferably larger than 0.002 g/cm$^2$ and smaller than 0.013 g/cm$^2$, and particularly preferably larger than 0.004 g/cm$^2$ and smaller than 0.008 g/cm$^2$.

Figure 6:
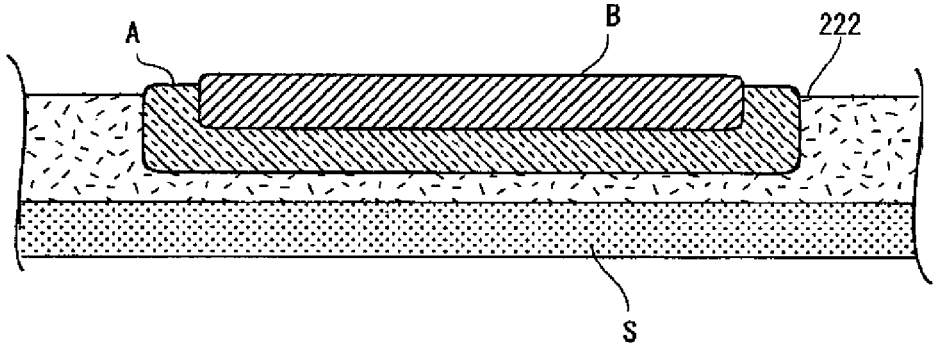
FIG. 6 is a sectional diagram of a printed matter which is obtained by further giving an ink liquid B onto an ink liquid A in a semi-cured state on a layer of an undercoating liquid in a semi-cured state.

FIG. 6 is a sectional diagram of a printed matter which is obtained by further giving an ink liquid B onto an ink liquid A in a semi-cured state on a layer of the undercoating liquid 222 in a semi-cured state.

When a second color is to be formed on the layer of the undercoating liquid 222 in a semi-cured state by the ink liquids A, B, it is preferable to give the ink liquid B onto the ink liquid A in a semi-cured state. In the case where droplets of the ink liquid B are deposited onto the ink liquid A in a semi-cured state, a state is formed where part of the ink liquid B sinks into the ink liquid A, and the ink liquid A exists below the ink liquid B. A printed matter which is obtained by giving the ink liquid B onto the ink liquid A in a semi-cured state has a section which is diagrammatically shown in FIG. 6. The state where a cured film (ink film A) of the ink liquid A and a cured film (ink film B) of the ink liquid B are stacked with each other enables excellent color reproduction to be performed.

Figure 7A:
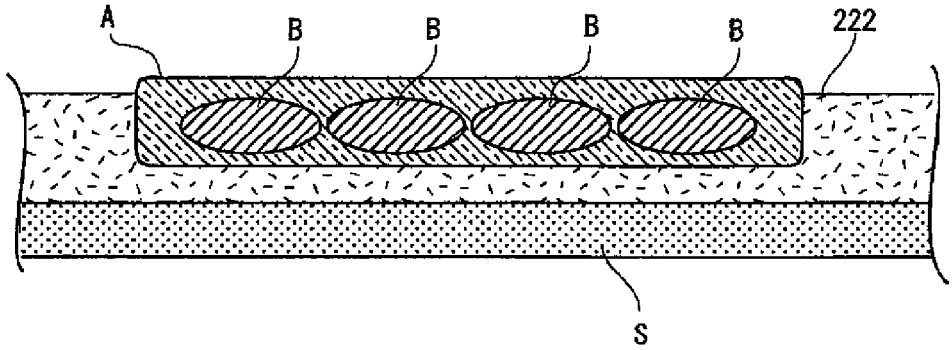
FIGS. 7A and 7B are sectional diagrams of a printed matter which is obtained by depositing droplets of an ink liquid B onto an ink liquid A in an uncured state.
Figure 7B:
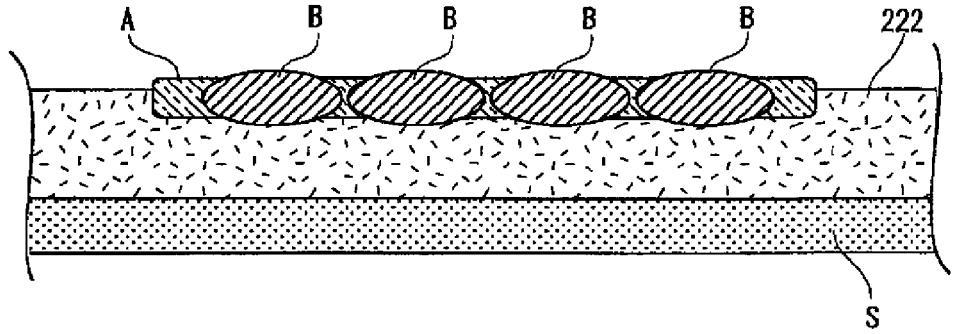

By contrast, FIGS. 7A and 7B are sectional diagrams of a printed matter which is obtained by depositing droplets of the ink liquid B onto the ink liquid A in an uncured state.

When droplets of the ink liquid B are deposited onto the ink liquid A in an uncured state, all of the ink liquid B sinks into the ink liquid A (FIG. 7A), and/or the ink liquid A does not exist below the ink liquid B (FIG. 7B). In this case, even when droplets of the ink liquid B are given in high density, the droplets of the ink liquid B are independent from one another, and hence this causes the chroma saturation of the second color to be lowered.

Figure 8:
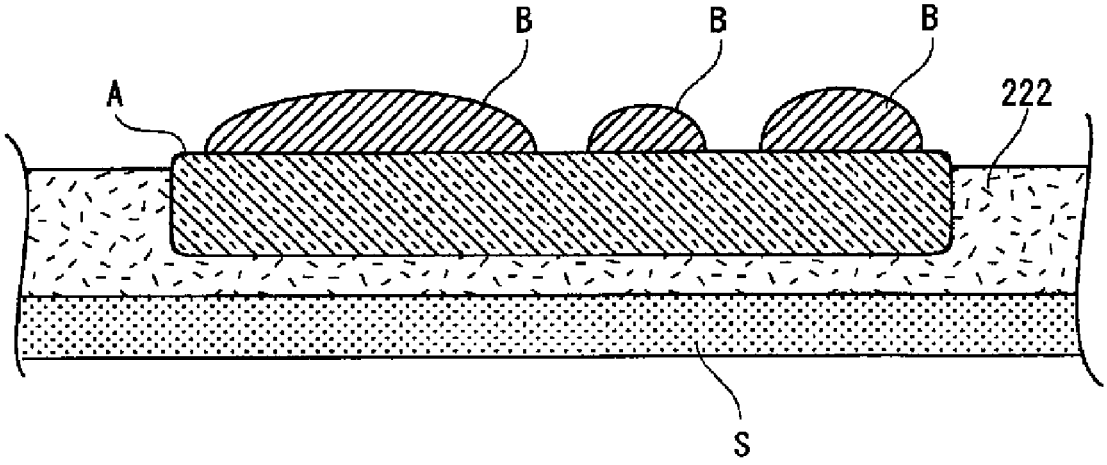
FIG. 8 is a sectional diagram of a printed matter which is obtained by depositing droplets of the ink liquid B onto the ink liquid A in a completely cured state.

FIG. 8 is a sectional diagram of a printed matter which is obtained by depositing droplets of the ink liquid B onto the ink liquid A in a completely cured state.

When droplets of the ink liquid B are deposited onto the completely cured ink liquid A, the ink liquid B does not sink into the ink liquid A. This state causes deposition interference to be produced, so that a uniform ink liquid film layer cannot be formed and the color reproducibility is lowered.

From the viewpoints that, when droplets of the ink liquid B are given in high density, a uniform layer of the ink liquid B is formed without causing the droplets to be independent from one another, and that production of deposition interference is suppressed, preferably, the quantity of an uncured portion of the ink liquid A per unit area is sufficiently smaller than the maximum liquid droplet quantity of an uncured portion of the ink liquid B to be given per unit area. Namely, the relationship between the weight M1 (ink liquid A) of an uncured portion of the layer of the ink liquid A per unit area and the maximum weight m1 (ink liquid B) of the ink liquid B ejected per unit area is preferably "m1 (ink liquid B)/30<M1 (ink liquid A)<m1 (ink liquid B)", more preferably "m1 (ink liquid B)/20<M1 (ink liquid A)<m1 (ink liquid B)/3", and particularly preferably "m1 (ink liquid B)/10<M1 (ink liquid A)<m1 (ink liquid B)/5".

When m1 (ink liquid B)/20≧M1 (ink liquid A), deposition interference is produced, and the reproducibility of the dot size is caused to be lowered. Therefore, this is not preferable. When M1 (ink liquid A)≧m1 (ink liquid B), a uniform layer of an ink liquid cannot be formed, and there is a possibility that the concentration is lowered. Therefore, this is not preferable.

The weight of an uncured portion of the ink liquid A per unit area was obtained by the transfer test described below. After the semi-curing process (for example, after irradiation of an active-energy ray) and before droplets of the ink liquid B are deposited, a permeation medium such as plain paper is pressed against a layer of the ink liquid A in a semi-cured state, and the weight of the quantity of the ink liquid A transferred to the permeation medium is measured, whereby the uncured portion weight is defined.

For example, it is assumed that the maximum ejection quantity of the ink liquid B is 12 pL (pico liters) per pixel when the deposited droplet density is 600×600 dpi. The maximum weight m1 (ink liquid) of the ink liquid B ejected per unit area is 0.04 g/cm$^2$ (when the density of the ink liquid B is assumed to be about 1.1 g/cm$^3$). Therefore, a preferred weight of an uncured portion of the layer of the ink liquid A is larger than 0.0013 g/cm$^2$ per unit area and smaller than 0.04 g/cm$^2$, more preferably larger than 0.002 g/cm$^2$ and smaller than 0.013 g/cm$^2$, and particularly preferably larger than 0.004 g/cm$^2$ and smaller than 0.008 g/cm$^2$.

In the case of a curing reaction based on an ethylenically unsaturated compound or cyclic ether, the unpolymerization rate can be quantitatively measured in accordance with the reaction rate of an ethylenically unsaturated group or a cyclic ether group (this will be described later).

In the case where the semi-cured state of the undercoating liquid and/or the ink liquid is realized by a polymerization reaction which is conducted on a polymerizable compound, and which begins upon irradiation of an active-energy ray or heating, the unpolymerization rate (A (postpolymerization)/A (prepolymerization)) is preferably equal to or larger than 0.2 and equal to or smaller than 0.9, more preferably equal to or larger than 0.3 and equal to or smaller than 0.9, and particularly preferably equal to or larger than 0.5 and equal to or smaller than 0.9.

In the above, A (postpolymerization) is the absorption brightness of an IR absorption peak due to a polymerizable group after a polymerization reaction, and A (prepolymerization) is the absorption brightness of an IR absorption peak due to a polymerizable group before a polymerization reaction. In the case where the polymerizable compound contained in the undercoating liquid and/or the ink liquid is an acrylate monomer or a methacrylate monomer, for example, an absorption peak due to the polymerizable group (the acrylate monomer or the methacrylate monomer) can be observed at the vicinity of 810 $cm^{-1}$, and the polymerization rate is preferably defined by the absorption brightness at the peak. In the case where the polymerizable compound is an oxetane compound, an absorption peak due to the polymerizable group (the oxetane ring) can be observed at the vicinity of 986 $cm^{-1}$, and the polymerization rate is preferably defined by the absorption brightness at the peak. In the case where the polymerizable compound is an epoxy compound, an absorption peak due to the polymerizable group (the epoxy group) can be observed at the vicinity of 750 $cm^{-1}$, and the polymerization rate is preferably defined by the absorption brightness at the peak.

As means for measuring the infrared absorption spectrum, an infrared spectrometer which is commercially available may be used. Either of transmittance and reflectance spectrometers may be used. Preferably, one of the spectrometers is adequately selected in accordance with the form of a sample. For example, the measurement can be performed by using Infrared Spectrometer FTS-6000 manufactured by BIO-RODO.

As a method of semi-curing the undercoating liquid and/or the ink liquid, preferably used is a known thickening method such as: (1) a method using a so-called aggregation method, such as that in which a basic compound is given to an acidic polymer, or an acidic compound or a metal compound is given to a basic polymer; (2) a method in which the undercoating liquid and/or the ink liquid is prepared to be highly viscous, a low-boiling organic solvent is added to the resulting liquid to reduce the viscosity, and the low-boiling organic solvent is evaporated to return the liquid to the original high-viscous state; (3) a method in which the undercoating liquid and/or ink liquid that is prepared to a high viscosity is heated, and then cooled to return the liquid to the original high-viscous state; or (4) a method in which an active-energy ray or heat is given to the undercoating liquid and/or the ink liquid to cause a curing reaction. Among the methods, the method (4) in which an active-energy ray or heat is given to the undercoating liquid and/or the ink liquid to cause a curing reaction is preferable.

In the method in which an active-energy ray or heat is given to cause an internal curing reaction, a polymerization reaction of a polymerizable compound in the surface of the undercoating liquid given to a recording medium is insufficiently performed. In the surface of the undercoating liquid, a polymerization reaction is inhibited more easily than the inside of the liquid because of the influence of oxygen in the air. Therefore, an internal curing reaction of the undercoating liquid can be caused by controlling the conditions of giving the active-energy ray or the heat.

The amount of an energy required for semi-curing the undercoating liquid and/or the ink liquid depends on the kind, content, or the like of a polymerization initiator. In the case where an energy is given by the active-energy ray, usually, the amount is preferably about 1 to 500 $mJ/cm^2$. In the case where an energy is given by heating, it is preferable to heat the liquid for 0.1 to 1 second under the conditions that the surface temperature of a recording medium is in the range of 40 to 80° C.

The generation of active species due to decomposition of the polymerization initiator is promoted by application of an active-energy ray or heat such as active light or heating, and the curing reaction by polymerization or crosslinking of a polymerizable or crosslinkable material due to active species is promoted by increasing of active species or temperature rise.

Also the thickening (increase of the viscosity) can be suitably performed by irradiation of active light or heating.

This application is based on Japanese Patent application JP 2007-089710, filed Mar. 29, 2007, the entire content of which is hereby incorporated by reference, the same as if fully set forth herein.

Although the invention has been described above in relation to preferred embodiments and modifications thereof, it will be understood by those skilled in the art that other variations and modifications can be effected in these preferred embodiments without departing from the scope and spirit of the invention.

What is claimed is:

1. An active-energy ray curable ink-jet recording apparatus comprising:

an active-energy ray irradiation source;

a plurality of full-line ink-jet heads which eject a liquid functional material that is curable by an active-energy ray, onto a recording medium which is scanned and transported;

a unit for applying a clear ink for undercoating, at a position upstream from said plurality of full-line ink-jet heads in the direction of transporting the recording medium; and a head controller for controlling said heads to form an image on the recording medium, wherein said plurality of full-line ink-jet heads comprise at least a black head and a yellow head on an extreme downstream side in a direction of transporting the recording medium, and wherein said head controller sets a range outside a yellow ejection range as an ejectable range of said black head.

2. The active-energy ray curable ink-jet recording apparatus according to claim 1, wherein said liquid functional material contains a pigment and wherein a pigment concentration of the liquid functional material is equal to or larger than 6 wt. % and smaller than 20 wt. %.

* * * * *